US011551512B2

(12) United States Patent
Watkins et al.

(10) Patent No.: US 11,551,512 B2
(45) Date of Patent: Jan. 10, 2023

(54) GAMING MACHINE, SYSTEM, AND METHOD FACILITATING BET CONFIGURATION BY BET LEVEL WITHIN A GIVEN GAME DENOMINATION

(71) Applicant: Everi Games, Inc., Austin, TX (US)

(72) Inventors: Brian Alexander Watkins, Austin, TX (US); Daniel Eulenfeld, Austin, TX (US)

(73) Assignee: Everi Games Inc., Austin, TX (US)

( * ) Notice: Subject to any disclaimer, the term of this patent is extended or adjusted under 35 U.S.C. 154(b) by 228 days.

(21) Appl. No.: 17/120,504

(22) Filed: Dec. 14, 2020

(65) Prior Publication Data

US 2021/0166522 A1 Jun. 3, 2021

Related U.S. Application Data

(63) Continuation of application No. 16/150,127, filed on Oct. 2, 2018, now Pat. No. 10,867,468, which is a continuation-in-part of application No. 15/230,502, filed on Aug. 8, 2016, now Pat. No. 10,580,263.

(60) Provisional application No. 62/566,915, filed on Oct. 2, 2017, provisional application No. 62/234,632, filed on Sep. 29, 2015.

(51) Int. Cl.
*G07F 17/32* (2006.01)
*G07F 17/34* (2006.01)

(52) U.S. Cl.
CPC ..... *G07F 17/3213* (2013.01); *G07F 17/3209* (2013.01); *G07F 17/3211* (2013.01); *G07F 17/3225* (2013.01); *G07F 17/3244* (2013.01); *G07F 17/34* (2013.01)

(58) Field of Classification Search
CPC ... G07F 17/32; G07F 17/3213; G07F 17/3244
See application file for complete search history.

(56) References Cited

U.S. PATENT DOCUMENTS

| | | | | |
|---|---|---|---|---|
| 9,564,020 | B1 | 2/2017 | D'Aquilante | |
| 2005/0049037 | A1 | 3/2005 | Anderson | |
| 2006/0035694 | A1 | 2/2006 | Fuller | |
| 2008/0058086 | A1 | 3/2008 | Saffari | |
| 2009/0088239 | A1 | 4/2009 | Iddings | |
| 2009/0093300 | A1 * | 4/2009 | Lutnick | G07F 17/3293 463/31 |
| 2013/0084931 | A1 | 4/2013 | Ditchev | |

* cited by examiner

*Primary Examiner* — James S. McClellan
(74) *Attorney, Agent, or Firm* — The Culbertson Group, P.C.; Russell D. Culbertson

(57) ABSTRACT

A method includes storing multiple bet configurations for a gaming machine. Each bet configuration specifies a respective pay table and a set of bet levels including a minimum bet level. A payout percentage may be selected for each bet level. The pay tables each include a number N of prize levels and each prize level corresponding to a respective numerical prize value for a win on the gaming machine while the corresponding bet configuration is in an active state at the gaming machine. The minimum bets for the different bet configurations are unequal and are related by a translation ratio. The different numerical prize values for the different bet configurations are also related by that same translating ratio. A bet configuration may be placed in the active state at a gaming machine and plays are then resolved according to the bet configuration in the active state.

20 Claims, 31 Drawing Sheets

RESET

• SELECT GAME DENOMINATION

If multi-denom is enabled, change credit value between plays by touching denomination.

• SELECT THE NUMBER OF CREDITS TO BET

Press the "PLAY" button to bet 30, 60, 90, 150, or 300 total credits.

• PRESS "PLAY" OR "MAX BET" TO START

"PLAY" will also rebet and start game. Maximum number of credits bet is 300.

• QUICK STOP BEHAVIOR

Pressing the "PLAY" button while the reels are spinning may cause the reels to stop immediately. A player cannot influence the result of a game by stopping the reel spins.

EXIT

EVERI

ONLY HIGHEST WINNER PAID PER LINE MALFUNCTION VOIDS ALL PAYS AND PLAYS
LINE WINS MUST OCCUR ON ADJACENT REELS, BEGINNING WITH THE LEFTMOST REEL

©2015 EVERI GAMES INC.

PAYOFFS ON REGISTERED CREDITS ONLY ALL PAYS IN CREDITS

FIG. 18B

Configurable Bet Level Information - 50C Min Bet

| Minimum Bet | 50 | Lines | 40 |
|---|---|---|---|

| | Bet Level | | | | | | | | | |
|---|---|---|---|---|---|---|---|---|---|---|
| Max Bet | 1 | 2 | 3 | 4 | 5 | 6 | 7 | 8 | 9 | 10 |
| 50 | 50 | - | - | - | - | - | - | - | - | - |
| 100 | 50 | 100 | - | - | - | - | - | - | - | - |
| 150 | 50 | 150 | - | - | - | - | - | - | - | - |
| 150 | 50 | 100 | 150 | - | - | - | - | - | - | - |
| 200 | 50 | 200 | - | - | - | - | - | - | - | - |
| 200 | 50 | 100 | 200 | - | - | - | - | - | - | - |
| 200 | 50 | 100 | 150 | 200 | - | - | - | - | - | - |
| 250 | 50 | 250 | - | - | - | - | - | - | - | - |
| 250 | 50 | 100 | 250 | - | - | - | - | - | - | - |
| 250 | 50 | 150 | 250 | - | - | - | - | - | - | - |
| 250 | 50 | 100 | 150 | 250 | - | - | - | - | - | - |
| 250 | 50 | 100 | 150 | 200 | 250 | - | - | - | - | - |
| 300 | 50 | 300 | - | - | - | - | - | - | - | - |
| 300 | 50 | 150 | 300 | - | - | - | - | - | - | - |
| 300 | 50 | 100 | 300 | - | - | - | - | - | - | - |
| 300 | 50 | 100 | 200 | 300 | - | - | - | - | - | - |
| 300 | 50 | 100 | 150 | 300 | - | - | - | - | - | - |
| 300 | 50 | 100 | 150 | 200 | 300 | - | - | - | - | - |
| 300 | 50 | 100 | 150 | 200 | 250 | 300 | - | - | - | - |
| 350 | 50 | 350 | - | - | - | - | - | - | - | - |
| 350 | 50 | 150 | 350 | - | - | - | - | - | - | - |
| 350 | 50 | 200 | 350 | - | - | - | - | - | - | - |
| 350 | 50 | 100 | 350 | - | - | - | - | - | - | - |
| 350 | 50 | 150 | 250 | 350 | - | - | - | - | - | - |
| 350 | 50 | 100 | 150 | 350 | - | - | - | - | - | - |
| 350 | 50 | 100 | 200 | 350 | - | - | - | - | - | - |
| 350 | 50 | 100 | 150 | 250 | 350 | - | - | - | - | - |
| 350 | 50 | 100 | 150 | 200 | 350 | - | - | - | - | - |
| 350 | 50 | 100 | 150 | 200 | 250 | 350 | - | - | - | - |
| 350 | 50 | 100 | 150 | 200 | 250 | 300 | 350 | - | - | - |
| 400 | 50 | 400 | - | - | - | - | - | - | - | - |
| 400 | 50 | 100 | 400 | - | - | - | - | - | - | - |
| 400 | 50 | 150 | 400 | - | - | - | - | - | - | - |
| 400 | 50 | 200 | 400 | - | - | - | - | - | - | - |
| 400 | 50 | 100 | 200 | 400 | - | - | - | - | - | - |
| 400 | 50 | 100 | 150 | 400 | - | - | - | - | - | - |
| 400 | 50 | 100 | 250 | 400 | - | - | - | - | - | - |
| 400 | 50 | 150 | 250 | 400 | - | - | - | - | - | - |
| 400 | 50 | 100 | 150 | 200 | 400 | - | - | - | - | - |
| 400 | 50 | 100 | 200 | 300 | 400 | - | - | - | - | - |
| 400 | 50 | 100 | 150 | 250 | 400 | - | - | - | - | - |
| 400 | 50 | 100 | 150 | 200 | 300 | 400 | - | - | - | - |
| 400 | 50 | 100 | 150 | 200 | 250 | 400 | - | - | - | - |
| 400 | 50 | 100 | 150 | 200 | 250 | 300 | 400 | - | - | - |
| 400 | 50 | 100 | 150 | 200 | 250 | 300 | 350 | 400 | - | - |

FIG. 20A

| | | | | | | | | | | |
|---|---|---|---|---|---|---|---|---|---|---|
| **500** | 50 | 500 | - | - | - | - | - | - | - | - |
| **500** | 50 | 250 | 500 | - | - | - | - | - | - | - |
| **500** | 50 | 100 | 500 | - | - | - | - | - | - | - |
| **500** | 50 | 150 | 500 | - | - | - | - | - | - | - |
| **500** | 50 | 200 | 500 | - | - | - | - | - | - | - |
| **500** | 50 | 150 | 250 | 500 | - | - | - | - | - | - |
| **500** | 50 | 150 | 300 | 500 | - | - | - | - | - | - |
| **500** | 50 | 200 | 350 | 500 | - | - | - | - | - | - |
| **500** | 50 | 100 | 300 | 500 | - | - | - | - | - | - |
| **500** | 50 | 100 | 250 | 500 | - | - | - | - | - | - |
| **500** | 50 | 100 | 200 | 500 | - | - | - | - | - | - |
| **500** | 50 | 100 | 150 | 500 | - | - | - | - | - | - |
| **500** | 50 | 150 | 250 | 350 | 500 | - | - | - | - | - |
| **500** | 50 | 100 | 150 | 200 | 500 | - | - | - | - | - |
| **500** | 50 | 100 | 150 | 250 | 500 | - | - | - | - | - |
| **500** | 50 | 100 | 150 | 300 | 500 | - | - | - | - | - |
| **500** | 50 | 100 | 200 | 300 | 500 | - | - | - | - | - |
| **500** | 50 | 100 | 200 | 350 | 500 | - | - | - | - | - |
| **500** | 50 | 100 | 200 | 300 | 400 | 500 | - | - | - | - |
| **500** | 50 | 100 | 150 | 250 | 350 | 500 | - | - | - | - |
| **500** | 50 | 100 | 150 | 200 | 350 | 500 | - | - | - | - |
| **500** | 50 | 100 | 150 | 200 | 300 | 500 | - | - | - | - |
| **500** | 50 | 100 | 150 | 200 | 250 | 500 | - | - | - | - |
| **500** | 50 | 100 | 150 | 200 | 250 | 350 | 500 | - | - | - |
| **500** | 50 | 100 | 150 | 200 | 250 | 300 | 500 | - | - | - |
| **500** | 50 | 100 | 150 | 200 | 300 | 400 | 500 | - | - | - |
| **500** | 50 | 100 | 150 | 200 | 250 | 300 | 350 | 500 | - | - |
| **500** | 50 | 100 | 150 | 200 | 250 | 300 | 400 | 500 | - | - |
| **500** | 50 | 100 | 150 | 200 | 250 | 300 | 350 | 400 | 500 | - |
| **500** | 50 | 100 | 150 | 200 | 250 | 300 | 350 | 400 | 450 | 500 |

FIG. 20B

| | | | | | | | | | | |
|---|---|---|---|---|---|---|---|---|---|---|
| 1000 | 50 | 100 | 1000 | - | - | - | - | - | - | - |
| 1000 | 50 | 500 | 1000 | - | - | - | - | - | - | - |
| 1000 | 50 | 450 | 1000 | - | - | - | - | - | - | - |
| 1000 | 50 | 400 | 1000 | - | - | - | - | - | - | - |
| 1000 | 50 | 350 | 1000 | - | - | - | - | - | - | - |
| 1000 | 50 | 300 | 1000 | - | - | - | - | - | - | - |
| 1000 | 50 | 250 | 1000 | - | - | - | - | - | - | - |
| 1000 | 50 | 200 | 1000 | - | - | - | - | - | - | - |
| 1000 | 50 | 150 | 1000 | - | - | - | - | - | - | - |
| 1000 | 50 | 100 | 150 | 1000 | - | - | - | - | - | - |
| 1000 | 50 | 250 | 500 | 1000 | - | - | - | - | - | - |
| 1000 | 50 | 200 | 500 | 1000 | - | - | - | - | - | - |
| 1000 | 50 | 200 | 400 | 1000 | - | - | - | - | - | - |
| 1000 | 50 | 150 | 500 | 1000 | - | - | - | - | - | - |
| 1000 | 50 | 150 | 250 | 1000 | - | - | - | - | - | - |
| 1000 | 50 | 100 | 500 | 1000 | - | - | - | - | - | - |
| 1000 | 50 | 100 | 300 | 1000 | - | - | - | - | - | - |
| 1000 | 50 | 100 | 250 | 1000 | - | - | - | - | - | - |
| 1000 | 50 | 100 | 200 | 1000 | - | - | - | - | - | - |
| 1000 | 50 | 150 | 250 | 500 | 1000 | - | - | - | - | - |
| 1000 | 50 | 100 | 300 | 500 | 1000 | - | - | - | - | - |
| 1000 | 50 | 100 | 250 | 500 | 1000 | - | - | - | - | - |
| 1000 | 50 | 100 | 250 | 400 | 1000 | - | - | - | - | - |
| 1000 | 50 | 100 | 200 | 500 | 1000 | - | - | - | - | - |
| 1000 | 50 | 100 | 200 | 400 | 1000 | - | - | - | - | - |
| 1000 | 50 | 100 | 200 | 300 | 1000 | - | - | - | - | - |
| 1000 | 50 | 100 | 150 | 500 | 1000 | - | - | - | - | - |
| 1000 | 50 | 100 | 150 | 400 | 1000 | - | - | - | - | - |
| 1000 | 50 | 100 | 150 | 250 | 1000 | - | - | - | - | - |
| 1000 | 50 | 100 | 200 | 300 | 500 | 1000 | - | - | - | - |
| 1000 | 50 | 100 | 200 | 300 | 400 | 1000 | - | - | - | - |
| 1000 | 50 | 100 | 150 | 300 | 500 | 1000 | - | - | - | - |
| 1000 | 50 | 100 | 150 | 250 | 500 | 1000 | - | - | - | - |
| 1000 | 50 | 100 | 150 | 250 | 400 | 1000 | - | - | - | - |
| 1000 | 50 | 100 | 150 | 200 | 300 | 1000 | - | - | - | - |
| 1000 | 50 | 100 | 150 | 200 | 250 | 1000 | - | - | - | - |
| 1000 | 50 | 100 | 150 | 200 | 350 | 1000 | - | - | - | - |
| 1000 | 50 | 100 | 150 | 200 | 400 | 1000 | - | - | - | - |
| 1000 | 50 | 100 | 150 | 200 | 500 | 1000 | - | - | - | - |
| 1000 | 50 | 100 | 150 | 200 | 300 | 400 | 1000 | - | - | - |
| 1000 | 50 | 100 | 150 | 200 | 300 | 450 | 1000 | - | - | - |
| 1000 | 50 | 100 | 150 | 200 | 300 | 500 | 1000 | - | - | - |
| 1000 | 50 | 100 | 150 | 200 | 350 | 500 | 1000 | - | - | - |
| 1000 | 50 | 100 | 150 | 250 | 350 | 500 | 1000 | - | - | - |
| 1000 | 50 | 100 | 150 | 200 | 250 | 500 | 1000 | - | - | - |
| 1000 | 50 | 100 | 150 | 200 | 250 | 450 | 1000 | - | - | - |
| 1000 | 50 | 100 | 150 | 200 | 250 | 400 | 1000 | - | - | - |
| 1000 | 50 | 100 | 150 | 200 | 250 | 350 | 1000 | - | - | - |
| 1000 | 50 | 100 | 150 | 200 | 250 | 300 | 1000 | - | - | - |
| 1000 | 50 | 100 | 150 | 200 | 250 | 300 | 450 | 1000 | - | - |
| 1000 | 50 | 100 | 150 | 200 | 250 | 300 | 500 | 1000 | - | - |
| 1000 | 50 | 100 | 150 | 200 | 250 | 350 | 450 | 1000 | - | - |
| 1000 | 50 | 100 | 150 | 200 | 250 | 350 | 500 | 1000 | - | - |
| 1000 | 50 | 100 | 150 | 200 | 300 | 400 | 500 | 1000 | - | - |
| 1000 | 50 | 100 | 150 | 200 | 250 | 300 | 400 | 1000 | - | - |
| 1000 | 50 | 100 | 150 | 200 | 250 | 300 | 350 | 1000 | - | - |
| 1000 | 50 | 100 | 150 | 200 | 250 | 300 | 350 | 450 | 1000 | - |
| 1000 | 50 | 100 | 150 | 200 | 250 | 300 | 350 | 500 | 1000 | - |
| 1000 | 50 | 100 | 150 | 200 | 250 | 300 | 400 | 500 | 1000 | - |
| 1000 | 50 | 100 | 150 | 200 | 250 | 300 | 350 | 400 | 1000 | - |
| 1000 | 50 | 100 | 150 | 200 | 250 | 300 | 350 | 400 | 500 | 1000 |
| 1000 | 50 | 100 | 150 | 200 | 250 | 300 | 400 | 500 | 600 | 1000 |
| 1000 | 50 | 100 | 150 | 200 | 250 | 300 | 400 | 500 | 750 | 1000 |

FIG. 20C

Configurable Bet Level Information - 40C Min Bet

| Minimum Bet | 40 | Lines | 40 |
|---|---|---|---|

| | Bet Level | | | | | | | | | |
|---|---|---|---|---|---|---|---|---|---|---|
| Max Bet | 1 | 2 | 3 | 4 | 5 | 6 | 7 | 8 | 9 | 10 |
| 40 | 40 | - | - | - | - | - | - | - | - | - |
| 80 | 40 | 80 | - | - | - | - | - | - | - | - |
| 120 | 40 | 120 | - | - | - | - | - | - | - | - |
| 120 | 40 | 80 | 120 | - | - | - | - | - | - | - |
| 160 | 40 | 160 | - | - | - | - | - | - | - | - |
| 160 | 40 | 80 | 160 | - | - | - | - | - | - | - |
| 160 | 40 | 80 | 120 | 160 | - | - | - | - | - | - |
| 200 | 40 | 200 | - | - | - | - | - | - | - | - |
| 200 | 40 | 80 | 200 | - | - | - | - | - | - | - |
| 200 | 40 | 120 | 200 | - | - | - | - | - | - | - |
| 200 | 40 | 80 | 120 | 200 | - | - | - | - | - | - |
| 200 | 40 | 80 | 120 | 160 | 200 | - | - | - | - | - |
| 240 | 40 | 240 | - | - | - | - | - | - | - | - |
| 240 | 40 | 120 | 240 | - | - | - | - | - | - | - |
| 240 | 40 | 80 | 240 | - | - | - | - | - | - | - |
| 240 | 40 | 80 | 160 | 240 | - | - | - | - | - | - |
| 240 | 40 | 80 | 120 | 240 | - | - | - | - | - | - |
| 240 | 40 | 80 | 120 | 160 | 240 | - | - | - | - | - |
| 240 | 40 | 80 | 120 | 160 | 200 | 240 | - | - | - | - |
| 280 | 40 | 280 | - | - | - | - | - | - | - | - |
| 280 | 40 | 120 | 280 | - | - | - | - | - | - | - |
| 280 | 40 | 160 | 280 | - | - | - | - | - | - | - |
| 280 | 40 | 80 | 280 | - | - | - | - | - | - | - |
| 280 | 40 | 120 | 200 | 280 | - | - | - | - | - | - |
| 280 | 40 | 80 | 120 | 280 | - | - | - | - | - | - |
| 280 | 40 | 80 | 160 | 280 | - | - | - | - | - | - |
| 280 | 40 | 80 | 120 | 200 | 280 | - | - | - | - | - |
| 280 | 40 | 80 | 120 | 160 | 280 | - | - | - | - | - |
| 280 | 40 | 80 | 120 | 160 | 200 | 280 | - | - | - | - |
| 280 | 40 | 80 | 120 | 160 | 200 | 240 | 280 | - | - | - |
| 320 | 40 | 320 | - | - | - | - | - | - | - | - |
| 320 | 40 | 80 | 320 | - | - | - | - | - | - | - |
| 320 | 40 | 120 | 320 | - | - | - | - | - | - | - |
| 320 | 40 | 160 | 320 | - | - | - | - | - | - | - |
| 320 | 40 | 80 | 160 | 320 | - | - | - | - | - | - |
| 320 | 40 | 80 | 120 | 320 | - | - | - | - | - | - |
| 320 | 40 | 80 | 200 | 320 | - | - | - | - | - | - |
| 320 | 40 | 120 | 200 | 320 | - | - | - | - | - | - |
| 320 | 40 | 80 | 120 | 160 | 320 | - | - | - | - | - |
| 320 | 40 | 80 | 160 | 240 | 320 | - | - | - | - | - |
| 320 | 40 | 80 | 120 | 200 | 320 | - | - | - | - | - |
| 320 | 40 | 80 | 120 | 160 | 240 | 320 | - | - | - | - |
| 320 | 40 | 80 | 120 | 160 | 200 | 320 | - | - | - | - |
| 320 | 40 | 80 | 120 | 160 | 200 | 240 | 320 | - | - | - |
| 320 | 40 | 80 | 120 | 160 | 200 | 240 | 280 | 320 | - | - |

FIG. 21

Configurable Bet Level Information - 30C Min Bet

| Minimum Bet | 30 | Lines | 40 |
|---|---|---|---|

| | Bet Level | | | | | | | | | |
|---|---|---|---|---|---|---|---|---|---|---|
| Max Bet | 1 | 2 | 3 | 4 | 5 | 6 | 7 | 8 | 9 | 10 |
| 30 | 30 | - | - | - | - | - | - | - | - | - |
| 60 | 30 | 60 | - | - | - | - | - | - | - | - |
| 90 | 30 | 90 | - | - | - | - | - | - | - | - |
| 90 | 30 | 60 | 90 | - | - | - | - | - | - | - |
| 120 | 30 | 120 | - | - | - | - | - | - | - | - |
| 120 | 30 | 60 | 120 | - | - | - | - | - | - | - |
| 120 | 30 | 60 | 90 | 120 | - | - | - | - | - | - |
| 150 | 30 | 150 | - | - | - | - | - | - | - | - |
| 150 | 30 | 60 | 150 | - | - | - | - | - | - | - |
| 150 | 30 | 90 | 150 | - | - | - | - | - | - | - |
| 150 | 30 | 60 | 90 | 150 | - | - | - | - | - | - |
| 150 | 30 | 60 | 90 | 120 | 150 | - | - | - | - | - |
| 180 | 30 | 180 | - | - | - | - | - | - | - | - |
| 180 | 30 | 90 | 180 | - | - | - | - | - | - | - |
| 180 | 30 | 60 | 180 | - | - | - | - | - | - | - |
| 180 | 30 | 60 | 120 | 180 | - | - | - | - | - | - |
| 180 | 30 | 60 | 90 | 180 | - | - | - | - | - | - |
| 180 | 30 | 60 | 90 | 120 | 180 | - | - | - | - | - |
| 180 | 30 | 60 | 90 | 120 | 150 | 180 | - | - | - | - |
| 210 | 30 | 210 | - | - | - | - | - | - | - | - |
| 210 | 30 | 90 | 210 | - | - | - | - | - | - | - |
| 210 | 30 | 120 | 210 | - | - | - | - | - | - | - |
| 210 | 30 | 60 | 210 | - | - | - | - | - | - | - |
| 210 | 30 | 90 | 150 | 210 | - | - | - | - | - | - |
| 210 | 30 | 60 | 90 | 210 | - | - | - | - | - | - |
| 210 | 30 | 60 | 120 | 210 | - | - | - | - | - | - |
| 210 | 30 | 60 | 90 | 150 | 210 | - | - | - | - | - |
| 210 | 30 | 60 | 90 | 120 | 210 | - | - | - | - | - |
| 210 | 30 | 60 | 90 | 120 | 150 | 210 | - | - | - | - |
| 210 | 30 | 60 | 90 | 120 | 150 | 180 | 210 | - | - | - |
| 240 | 30 | 240 | - | - | - | - | - | - | - | - |
| 240 | 30 | 60 | 240 | - | - | - | - | - | - | - |
| 240 | 30 | 90 | 240 | - | - | - | - | - | - | - |
| 240 | 30 | 120 | 240 | - | - | - | - | - | - | - |
| 240 | 30 | 60 | 120 | 240 | - | - | - | - | - | - |
| 240 | 30 | 60 | 90 | 240 | - | - | - | - | - | - |
| 240 | 30 | 60 | 150 | 240 | - | - | - | - | - | - |
| 240 | 30 | 90 | 150 | 240 | - | - | - | - | - | - |
| 240 | 30 | 60 | 90 | 120 | 240 | - | - | - | - | - |
| 240 | 30 | 60 | 120 | 180 | 240 | - | - | - | - | - |
| 240 | 30 | 60 | 90 | 150 | 240 | - | - | - | - | - |
| 240 | 30 | 60 | 90 | 120 | 180 | 240 | - | - | - | - |
| 240 | 30 | 60 | 90 | 120 | 150 | 240 | - | - | - | - |
| 240 | 30 | 60 | 90 | 120 | 150 | 180 | 240 | - | - | - |
| 240 | 30 | 60 | 90 | 120 | 150 | 180 | 210 | 240 | - | - |

FIG. 22

Configurable Bet Level Information - 20C Min Bet

| Minimum Bet | 20 | Lines | 40 |
|---|---|---|---|

| | Bet Level | | | | | | | | | |
|---|---|---|---|---|---|---|---|---|---|---|
| Max Bet | 1 | 2 | 3 | 4 | 5 | 6 | 7 | 8 | 9 | 10 |
| 20 | 20 | - | - | - | - | - | - | - | - | - |
| 40 | 20 | 40 | - | - | - | - | - | - | - | - |
| 60 | 20 | 60 | - | - | - | - | - | - | - | - |
| 60 | 20 | 40 | 60 | - | - | - | - | - | - | - |
| 80 | 20 | 80 | - | - | - | - | - | - | - | - |
| 80 | 20 | 40 | 80 | - | - | - | - | - | - | - |
| 80 | 20 | 40 | 60 | 80 | - | - | - | - | - | - |
| 100 | 20 | 100 | - | - | - | - | - | - | - | - |
| 100 | 20 | 40 | 100 | - | - | - | - | - | - | - |
| 100 | 20 | 60 | 100 | - | - | - | - | - | - | - |
| 100 | 20 | 40 | 60 | 100 | - | - | - | - | - | - |
| 100 | 20 | 40 | 60 | 80 | 100 | - | - | - | - | - |
| 120 | 20 | 120 | - | - | - | - | - | - | - | - |
| 120 | 20 | 60 | 120 | - | - | - | - | - | - | - |
| 120 | 20 | 40 | 120 | - | - | - | - | - | - | - |
| 120 | 20 | 40 | 80 | 120 | - | - | - | - | - | - |
| 120 | 20 | 40 | 60 | 120 | - | - | - | - | - | - |
| 120 | 20 | 40 | 60 | 80 | 120 | - | - | - | - | - |
| 120 | 20 | 40 | 60 | 80 | 100 | 120 | - | - | - | - |
| 140 | 20 | 140 | - | - | - | - | - | - | - | - |
| 140 | 20 | 60 | 140 | - | - | - | - | - | - | - |
| 140 | 20 | 80 | 140 | - | - | - | - | - | - | - |
| 140 | 20 | 40 | 140 | - | - | - | - | - | - | - |
| 140 | 20 | 60 | 100 | 140 | - | - | - | - | - | - |
| 140 | 20 | 40 | 60 | 140 | - | - | - | - | - | - |
| 140 | 20 | 40 | 80 | 140 | - | - | - | - | - | - |
| 140 | 20 | 40 | 60 | 100 | 140 | - | - | - | - | - |
| 140 | 20 | 40 | 60 | 80 | 140 | - | - | - | - | - |
| 140 | 20 | 40 | 60 | 80 | 100 | 140 | - | - | - | - |
| 140 | 20 | 40 | 60 | 80 | 100 | 120 | 140 | - | - | - |
| 160 | 20 | 160 | - | - | - | - | - | - | - | - |
| 160 | 20 | 40 | 160 | - | - | - | - | - | - | - |
| 160 | 20 | 60 | 160 | - | - | - | - | - | - | - |
| 160 | 20 | 80 | 160 | - | - | - | - | - | - | - |
| 160 | 20 | 40 | 80 | 160 | - | - | - | - | - | - |
| 160 | 20 | 40 | 60 | 160 | - | - | - | - | - | - |
| 160 | 20 | 40 | 100 | 160 | - | - | - | - | - | - |
| 160 | 20 | 60 | 100 | 160 | - | - | - | - | - | - |
| 160 | 20 | 40 | 60 | 80 | 160 | - | - | - | - | - |
| 160 | 20 | 40 | 80 | 120 | 160 | - | - | - | - | - |
| 160 | 20 | 40 | 60 | 100 | 160 | - | - | - | - | - |
| 160 | 20 | 40 | 60 | 80 | 120 | 160 | - | - | - | - |
| 160 | 20 | 40 | 60 | 80 | 100 | 160 | - | - | - | - |
| 160 | 20 | 40 | 60 | 80 | 100 | 120 | 160 | - | - | - |
| 160 | 20 | 40 | 60 | 80 | 100 | 120 | 140 | 160 | - | - |

FIG. 23

GAMING MACHINE, SYSTEM, AND METHOD FACILITATING BET CONFIGURATION BY BET LEVEL WITHIN A GIVEN GAME DENOMINATION

CROSS-REFERENCE TO RELATED APPLICATIONS

This application is a continuation of U.S. patent application Ser. No. 16/150,127 filed Oct. 2, 2018 and entitled "Gaming Machine, System, and Method Facilitating Bet Configuration and Payout Percentage Selection by Bet Level Within a Given Game Denomination" to be issued as U.S. Pat. No. 10,867,468, which claimed the benefit, under 35 U.S.C. § 119(e), of U.S. Provisional Patent Application No. 62/566,915 filed Oct. 2, 2017, and entitled "Gaming Machine, System, and Method Facilitating Bet Configuration Within a Given Game Denomination Including Payout Percentage Selection By Bet Level." U.S. patent application Ser. No. 16/150,127 is also a continuation-in-part of U.S. patent application Ser. No. 15/230,502 filed Aug. 8, 2016, and entitled "Gaming Machine, System, and Method Facilitating Bet Configuration Within a Given Game Denomination," now U.S. Pat. No. 10,580,263, which claimed the benefit, under 35 U.S.C. § 119(e), of U.S. Provisional Patent Application No. 62/234,632 filed Sep. 29, 2015, entitled "Gaming Machine, System, and Method Providing Flexible Bet Configuration Within a Given Game Denomination." The entire content of each of the above-identified provisional and nonprovisional applications is incorporated herein by this reference.

COPYRIGHT NOTICE

A portion of the disclosure of this patent document contains material which is subject to copyright protection. The copyright owner has no objection to the facsimile reproduction of the patent document or the patent disclosure, as it appears in the U.S. Patent and Trademark Office records, but otherwise reserves all rights of copyright whatsoever.

TECHNICAL FIELD OF THE INVENTION

The present invention relates to gaming machines and gaming machine systems which facilitate numerous bet configuration options for a given game denomination without changing the play characteristics of the underlying wagering game. The configuration options may include configuration of payout percentage per bet level at a given denomination with concurrent changes in a button panel for the wagering game to indicate the variation in payout percentage across the various configured bet levels.

BACKGROUND OF THE INVENTION

Mechanical and video reel-type wagering games display results for a given play in the game using a matrix of game symbol locations through which various winning symbol location patterns commonly referred to as "paylines" are defined. In the course of a play in such a game (which may be referred to generally as a "slot game"), the various game symbols appearing at the different game symbol locations are randomized or selected according a random result. A prize of some nature is then awarded when a predefined set of game symbols is shown in the matrix of game symbol locations along any of the paylines which are active for that play. The predefined sets of game symbols are defined in a pay table which relates each such set of game symbols to a respective prize, or multiple prizes with each prize corresponding to the player's bet level for the play in the game.

A method previously used in the wagering industry to offer multiple options for a minimum bet in one of these types of wagering games is to simply vary the number of paylines which may be selected for a given play. That is, a game may be created with versions to play with 10, 20, 30, 40, or 50 paylines, each of which has the same minimum bet as the number of paylines. This method has various drawbacks related to the fact that changing the number of paylines changes the game's math model. For example, dropping to fewer paylines drops the hit percentage of the game.

Another method used in the wagering industry to offer options for a minimum be in a given game is to offer the game in different denominations. However, game denomination may not be selectable by a player at a gaming machine, and in any event, many players prefer to play at lower denomination gaming machines (for example, penny denomination gaming machines as opposed to dollar denomination gaming machines) and might be hesitant to change the denomination of a gaming machine to a higher denomination even if that option was available.

There remains a need in the gaming industry for gaming machines and systems which facilitate flexible gaming machine configuration, particularly without changing the play characteristics of the underlying game.

SUMMARY OF THE INVENTION

A first aspect of the present invention includes a method of configuring a gaming machine to provide multiple different minimum bet levels for a wagering game at a given game denomination. Methods according to this aspect of the invention may apply to gaming machines which display a result of a respective play through a matrix of game symbol locations which are each adapted to be populated for the play with a respective game symbol selected from a set of game symbols. This includes mechanical and video reel-type games in which the various reels or video simulated reels display the game symbols in a matrix of game symbol locations defined by the visible portion of the reels, and in which paylines or other patterns (including scatter pays) are defined through the matrix to provide a set of one or more winning symbol location patterns.

A method according to this first aspect of the invention includes storing a first bet configuration and a second bet configuration at a data storage system operatively connected to the gaming machine. "Operatively connected" in this sense means that the data storage system is accessible to the gaming machine in some fashion so that the data making up the first and second bet configurations may be read and used by processing devices associated with the gaming machine. The first bet configuration specifies a first configuration pay table and a first configuration set of bet levels which include a first configuration minimum bet for a play on the gaming machine and a first configuration higher-level bet for a play on the gaming machine, the first configuration higher-level bet being a multiple of the first configuration minimum bet. In addition to the first configuration pay table and first configuration set of bet levels, the first bet configuration may specify a first configuration payout percentage applicable for the first configuration minimum bet and a different payout percentage applicable for the first configuration higher-level bet. The configuration first pay table includes a number N of prize levels with each prize level corresponding to a respective first configuration numerical prize value for a respective win (combination of certain game symbols in a winning symbol location pattern) for a play on the gaming machine while the first bet configuration is in an active state at the gaming machine.

The second bet configuration similarly specifies a second configuration pay table and second configuration set of bet levels including a second configuration minimum bet and a second configuration higher-level bet. The second configuration higher-level bet similarly comprises a multiple of the second configuration minimum bet. The second configuration pay table includes the same number N prize levels as the first configuration pay table and each prize level of the second configuration pay table similarly corresponds to a respective second configuration numerical prize value for a win for a play in the game when second bet configuration is in an active state at the gaming machine. However, the second configuration minimum bet is unequal to the first configuration minimum bet, but related to the first configuration minimum bet by a translation ratio (a fixed mathematical ratio), and each second configuration numerical prize value is also related to a corresponding one of the first configuration numerical prize values by that same translation ratio.

A method according to this aspect of the invention also includes receiving a bet configuration activation input selecting the first bet configuration or selecting the second bet configuration. The bet configuration activation input is received through a user interface system for the gaming machine and causes the selected bet configuration (the first bet configuration or second bet configuration) to be placed in an active state for the gaming machine. A game play input received through a player input system of the gaming machine causes the gaming machine to conduct a play at a selected bet level on the gaming machine to populate the matrix of game symbol locations. For each win shown in the matrix (that is, for each winning combination of game symbols in a respective winning symbol location pattern in the matrix) the method includes awarding the respective prize for that combination of game symbols as defined by the bet level for the play and by the first or second configuration pay table corresponding to the bet configuration then in the active state at the gaming machine due to the bet configuration activation input previously received through the user interface system.

It will be noted that while the above summary describes only two bet configurations, a first and second such configuration, there may be any number of additional bet configurations each specifying a respective additional configuration pay table and respective additional configuration set of bet levels. Also, although only a single higher-level bet is mentioned in the above description of the two sets of bet levels, a set of bet levels designated according to the present invention for a given bet configuration may include any number of bet levels, and typically from as little as two bet levels including the minimum bet level to as many as ten or more including the minimum bet level. This method of facilitating different bet configurations and enabling a user to activate a particular bet configuration allows the gaming machine to be configured with a desired minimum bet level at a given denomination without requiring a corresponding change in the number of paylines active for a play at the gaming machine. Methods according to this aspect of the invention allow a single gaming machine to implement a game which maintains the same play characteristics at numerous different minimum bet levels aside from different payout percentages which may be selected for different bet levels in a given bet configuration.

As noted above, methods according to the present invention include storing a first bet configuration for a game denomination and at least one other, that is, a second bet configuration for that game denomination. While implementations of the invention may include storing different bet configurations simultaneously so that placing a given bet configuration in an active state comprises selecting between contemporaneously stored bet configurations which are both ready to be made active at the gaming machine, implementations of the invention are not limited to selection of bet configurations between contemporaneously stored, inactive bet configurations. For example, setting up a first bet configuration through a user interface at one point in time represents a storage of that first bet configuration and setting up a second bet configuration through the user interface at another point in time represents a storage of that second bet configuration.

Another aspect of the present invention comprises gaming machines controlled to implement the above method. A gaming machine according to this second aspect of the invention may include a display system, data storage system for storing selectable configuration information and completed bet configurations, a user interface for receiving inputs to create a desired bet configuration and place that bet configuration in an activate state at the gaming machine. Additionally, a gaming machine according to the second aspect of the invention may include a player input system for facilitating player inputs to initiate game plays at bet levels defined for a bet configuration in an active state for the gaming machine, and at least one processor operable to execute program code to perform methods according to the invention. Also, because such a gaming machine may be implemented using one or more general purpose processing devices to direct the various functions described above, and in more detail below, a third aspect of the invention encompasses program products comprising non-transitory storage media storing program code which is executable to direct the various gaming machine functions. A program product according to this third aspect of the invention may include game program code executable to conduct a play on a gaming machine and bet configuration program code to facilitate the selection and activation of a bet configuration according to the invention. Payout program code may also be included in the program product, executable to award the prizes defined by the bet configuration which is active for a given game play and by the bet level defined within that be configuration. Methods, gaming machines, and program products according to these aspects of the invention will be described in more detail below in connection with the drawings.

The different aspects of the present invention all also support bet configurations that provide different numbers of bet levels. In these implementations, placing a given bet configuration in the active state includes modifying the player input system of the gaming machine. The modification ensures that each bet level includes a control for allowing a player to conveniently select the desired bet level from the various levels available for a given bet configuration. In particular, the player input system may be modified to include a respective control corresponding to each bet multiplier included in a series of bet multipliers specifying different bet levels for the given bet configuration. Where the player input system includes a touch screen display, this modification of the player input system may include controlling the touch screen display to generate a touch screen control graphic to increase a total number of touch screen controls or to remove a touch screen control graphic to reduce a total number of such controls. Where the player input system includes physical buttons or other physical controls for selecting bet levels, the modification of the player input system may include activating a physical control in the player input system so that the control is responsive to the player or deactivating a previously active physical control.

In any of the aspects of the present invention, payout percentage for a play at a given bet level for a bet configuration may be selected from a set of available payout percentages for a given pay table. Payout percentage, which is also commonly referred to as "return to player" or "RTP" represents the expected payout as a fraction of the wagers placed in the game over a large number of plays. A payout percentage of 95%, for example, would return to the players as winnings 95% of the value placed as wagers over a large number of plays, whereas a payout percentage of 98%, would return to the players as winnings 98% of the value placed as wagers over a large number of plays. The ability to select payout percentage for the different bet levels of a bet configuration allows games to be configured so as to reward players for making higher-level bets. For example, the payout percentage for a minimum level bet configured according to the invention may be set at 90% whereas the payout percentage for one or more higher-level bets may be set at a higher percentage, 94% for example. Each aspect of the invention may also include in addition to modifying the number of bet level controls as described in the previous paragraph, modifying the player input system to display an indication of relative payout percentage for at least some of the different bet level controls.

Methods according to the present invention may also include steps for accommodating the large number of bet configurations and the concomitant information that is presented at the gaming machine to facilitate play. Among these steps, embodiments of the invention may include storing screen templates for various screens (graphic displays) that may be shown on a video display at the gaming machine, together with bet configuration-specific data files. The screen templates include information that causes the gaming machine to generate portions of a graphic display that is constant from one bet configuration that may be selected to another. The bet configuration-specific data files include data such as data for generating bet level button descriptions which change from one bet configuration to another. When a bet configuration is placed in the active state, data from the screen template and data from the bet configuration-specific data files for the selected bet configuration are used together to generate the desired graphic display to display information at the gaming machine.

These and other advantages and features of the invention will be apparent from the following description of representative embodiments, considered along with the accompanying drawings.

BRIEF DESCRIPTION OF THE DRAWINGS

FIG. 18B is a representation of a help screen used in connection with the pay table display of FIG. 18A.

FIG. 20A is a first portion of a table showing the progressions of bet levels available for each different user-specified maximum bet, with each progression starting at a minimum bet level of 50 credits.

FIG. 20B is a second portion of the table shown in FIG. 20A.

FIG. 20C is a third portion of the table shown in FIG. 20A.

FIG. 21 is a first portion of a table showing the progressions of bet levels available for different user-specified maximum bets, with each progression starting at a minimum bet level of 40 credits.

FIG. 22 is a first portion of a table showing progressions of bet levels available for different user-specified maximum bets, with each progression starting at a 30 credit minimum bet.

FIG. 23 is a first portion of a table showing progressions of bet levels available for different user-specified maximum bets with each progression starting at a 20 credit minimum bet.

DESCRIPTION OF REPRESENTATIVE EMBODIMENTS

Figure 15:
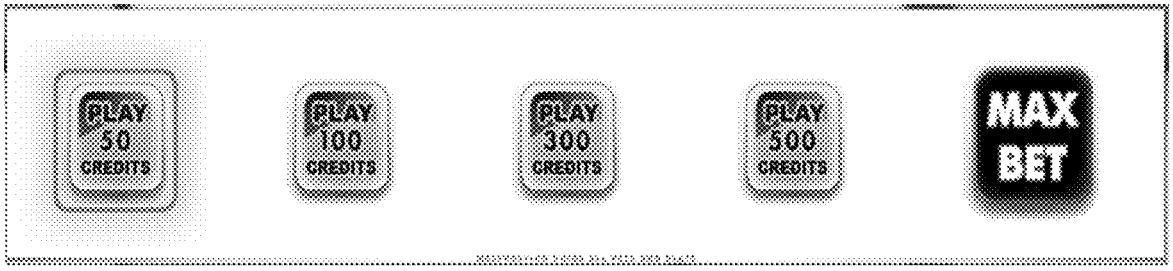
FIG. 15 is a representation of a button panel which may be displayed on a touch-screen button panel display where four bet levels have been selected according to the example process shown in FIG. 5.
Figure 16:
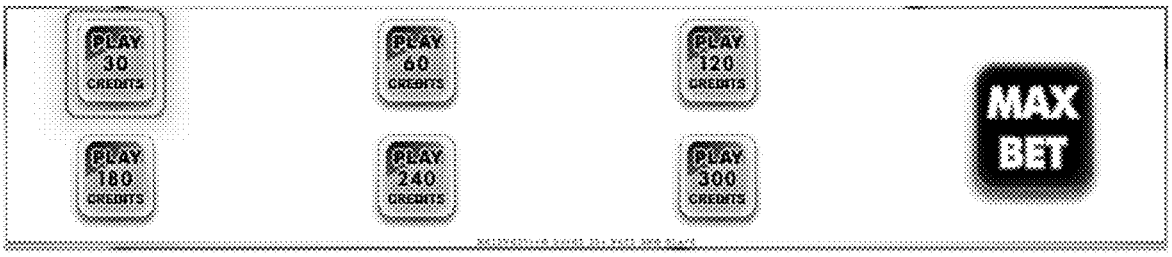
FIG. 16 is a representation of a button panel which may be displayed on a touch-screen button panel display where six bet levels have been selected according to the example process shown in FIG. 5.
Figure 17:
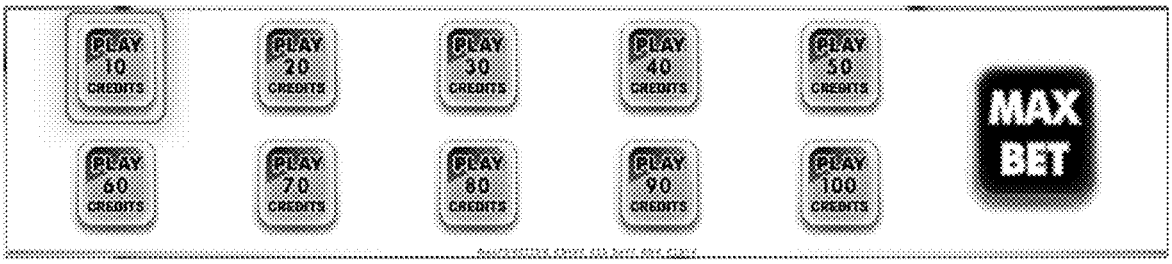
FIG. 17 is a representation of a button panel which may be displayed on a touch-screen button panel display where ten bet levels have been selected according to the example process shown in FIG. 5.
Figure 31:
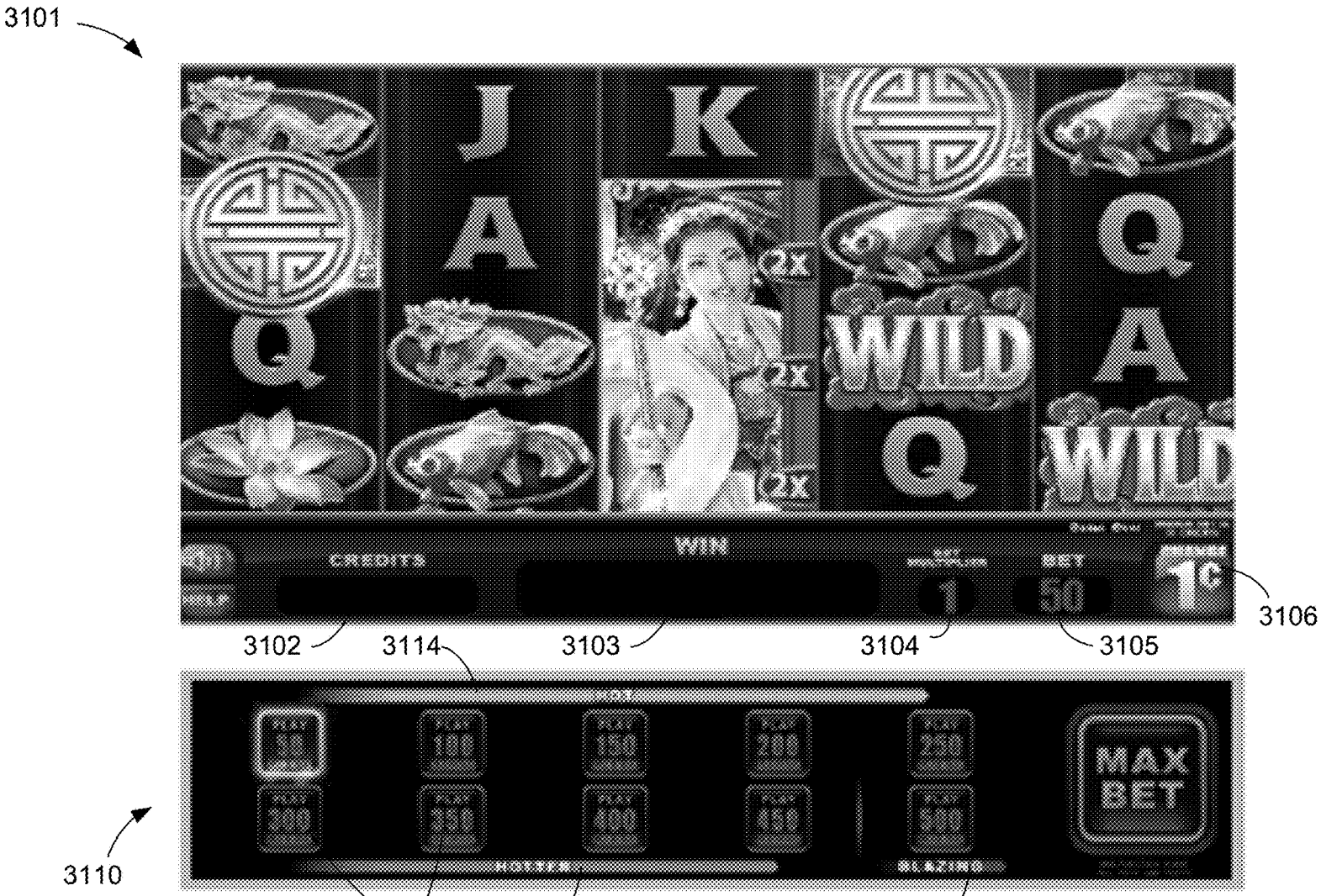
FIG. 31 is a representation of a game presentation and corresponding touch-screen button panel for a bet configuration made according to the principles of the present invention, including the configuration of payout percentage by bet level.
Figure 32:
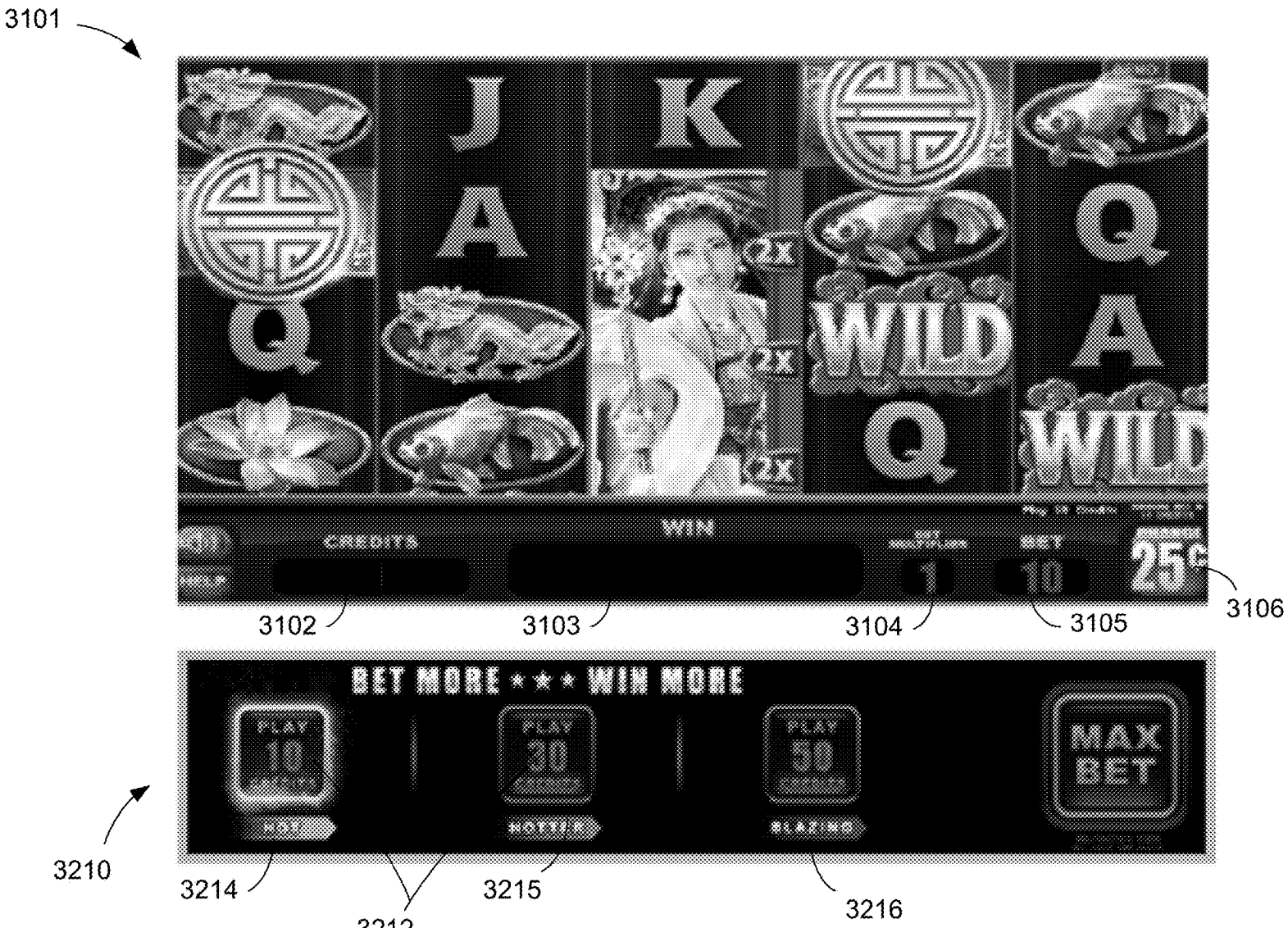
FIG. 32 is a representation of the game presentation shown in FIG. 31 but with a corresponding touch-screen button panel for a different bet configuration.

In the following description, FIGS. 1-3 will be used to describe example gaming machines and gaming networks through which the present invention may be implemented. FIG. 4 will be used to describe a game presentation which may be used to display results for wagering games configured according to the present invention. Processes which are illustrative of various embodiments of the invention will then be described in connection with the flow chart of FIG. 5 and user interfaces of FIGS. 6-14. FIGS. 15-17 provide examples of bet level button layouts that may be configured according to the present invention, while FIGS. 18A-B and 19A-B show how screens displayed at the gaming machine change from one bet configuration to another. FIGS. 20A-23 illustrate the type of configurability of maximum bet and bet level that is possible according to the invention. FIGS. 24-30 will be referenced below to describe how bet level buttons may be modified from one bet configuration to the next to indicate relative payout percentage for the various available bet levels. FIGS. 31 and 32 will be used to describe example reel-type game displays and corresponding button panels configured according to aspects of the present invention.

Figure 1:
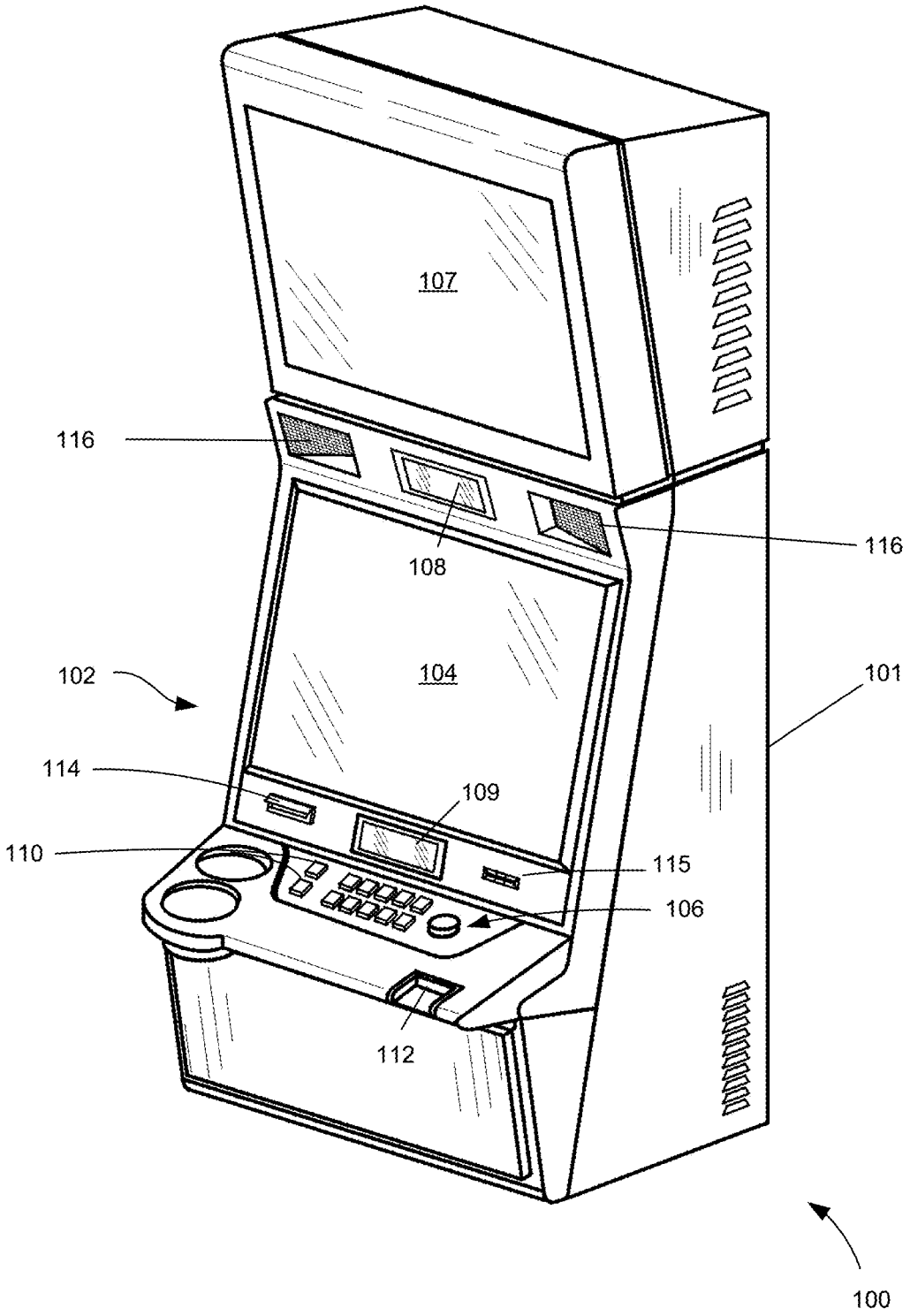
FIG. 1 is a view in perspective of a gaming machine which may be employed to implement various embodiments of the present invention.

FIG. 1 shows a gaming machine 100 that may be used in implementing a wagering game which may be configured according to the present invention. The block diagram of FIG. 2 shows further details of gaming machine 100 along with certain variations which may be included in the gaming machine. FIG. 3 shows an example gaming network in which gaming machines such as gaming machine 100 may be employed.

Referring to FIG. 1, gaming machine 100 includes a cabinet 101 having a front side generally shown at reference numeral 102. A primary video display device 104 is mounted in a central portion of the front side 102, and a button panel 106 is positioned below the primary video display device so as to project forwardly from the plane of the primary video display device. In addition to primary video display device 104, the illustrated gaming machine 100 includes a secondary video display device 107 positioned above the primary video display device. Gaming machine 100 also includes two additional smaller auxiliary display devices, an upper auxiliary display device 108 and a lower auxiliary display device 109. It should also be noted that each display device referenced herein may include any suitable display device including a cathode ray tube, liquid crystal display, plasma display, LED display, or any other type of display device currently known or that may be developed in the future. One or more of these video display devices, and especially primary video display device 104, may be used to display graphics used to display symbol location sets and other elements according to the present invention. As will be described further below in connection with FIG. 2 and elsewhere, it is also possible for gaming machines within the scope of the present invention to include mechanical elements such as mechanical reels. In these mechanical reel implementations, the mechanical reels may be used to display the game symbol locations. Generally, the display device or display devices of the gaming machine, whether video display devices, mechanical devices, or combinations of the two, which are used to display graphic elements according to embodiments of the invention may be described in this disclosure and the accompanying claims as a "display system."

The gaming machine 100 illustrated for purposes of example in FIG. 1 also includes a number of mechanical control buttons 110 mounted on button panel 106. These control buttons 110 may allow a player to select a bet level, select a type of game or game feature, and make a play input to start a play in a game. Other forms of gaming machines through which the invention may be implemented may include switches, joysticks, or other mechanical input devices, and/or virtual buttons and other controls implemented on a suitable touch screen video display. For example, primary video display device 104 in gaming machine 100 provides a convenient display device for implementing touch screen controls in addition to or in lieu of mechanical controls included on button panel 106. Also, as will be described further below, button panel 106 may comprise a touch screen display that may be controlled to produce any desired touch screen button configuration, particularly to accommodate different numbers of bet levels for a given game and denomination and to accommodate indications of relative payout percentage for different bet levels. The player interface devices which receive player inputs in the course of a game played through the gaming machine, such as controls to select a wager amount for a given play, controls to enter a play input to actually start a given play in the wagering game or tournament game, or controls to allow a player to select bet levels or make other player selections in a game according to the present invention, may be referred to generally as a "player input system."

It will be appreciated that gaming machines may also include a number of other player interface devices in addition to devices that are considered player controls for use in entering inputs in the course of a particular game. Gaming machine 100 also includes a currency/voucher acceptor having an input ramp 112, a player card reader having a player card input 114, and a voucher/receipt printer having a voucher/receipt output 115. Numerous other types of player interface devices may be included in gaming machines that may be used to implement embodiments of the present invention.

A gaming machine which may be used to implement embodiments of the present invention may also include a sound system to provide an audio output to enhance the user's playing experience. For example, illustrated gaming machine 100 includes speakers 116 which may be driven by a suitable audio amplifier (not shown) to provide a desired audio output at the gaming machine.

Figure 2:
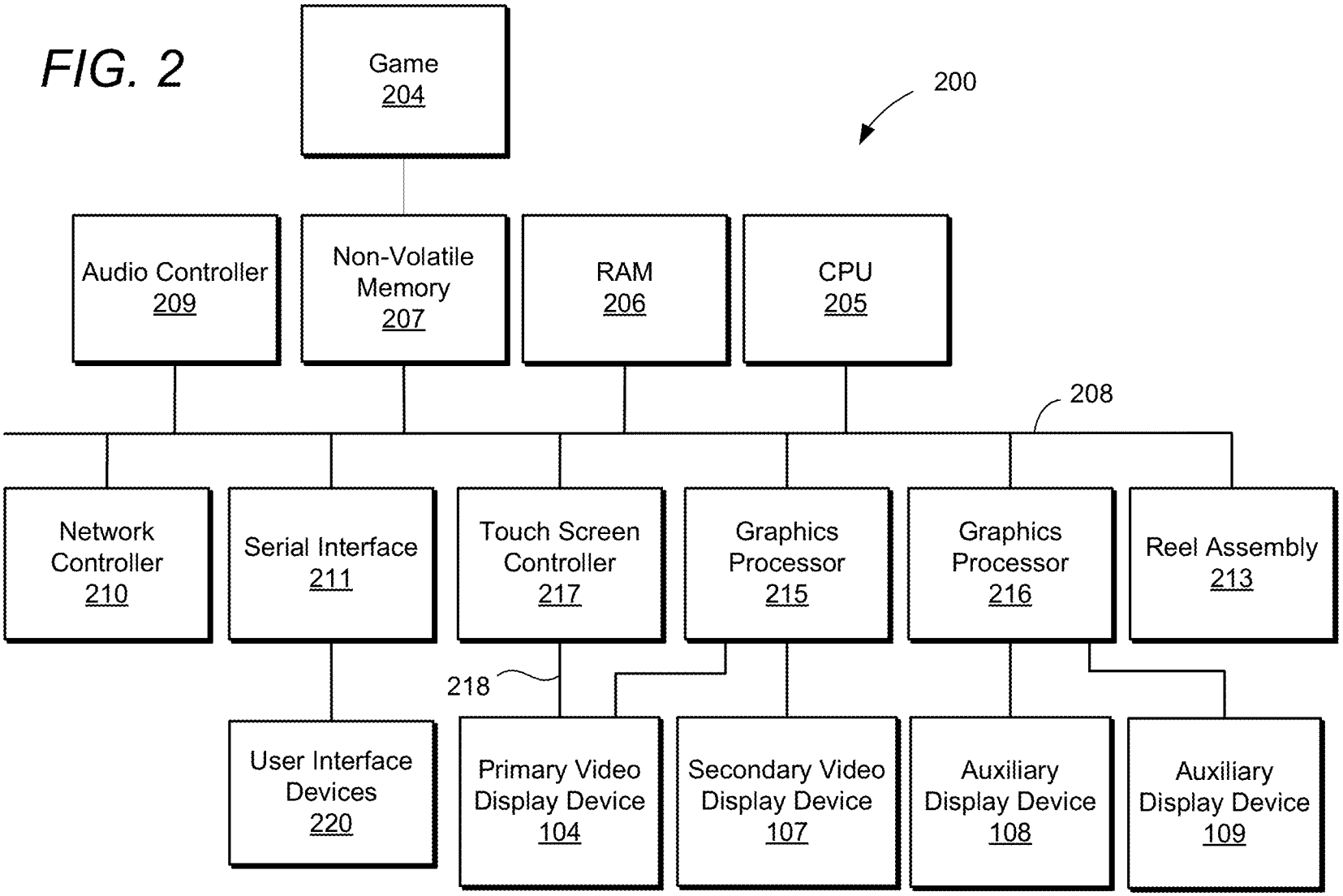
FIG. 2 is a schematic representation of the gaming machine shown in FIG. 1 showing various components of the gaming machine.

FIG. 2 shows a logical and hardware schematic diagram 200 of gaming machine 100 which includes a processor (CPU) 205 along with random access memory (RAM) 206 and nonvolatile memory or storage device 207. All of these devices are connected on a system bus 208 with an audio controller device 209, a network controller 210, and a serial interface 211. A graphics processor 215 is also connected on bus 208 and is connected to drive primary video display device 104 and secondary video display device 107 (both mounted on cabinet 101 as shown in FIG. 1). A second graphics processor 216 is also connected on bus 208 in this example to drive the auxiliary display devices 108 and 109 also shown in FIG. 1. As shown in FIG. 2, gaming machine 100 also includes a touch screen controller 217 connected to system bus 208. Touch screen controller 217 is also connected via signal path 218 to receive signals from a touch screen element associated with primary video display device 104. It will be appreciated that the touch screen element itself typically comprises a thin film that is secured over the display surface of the respective display device, in this case primary video display device 104. The touch screen element itself is not illustrated or referenced separately in the figures. An additional touch screen controller may be included in the system to receive signals from a touch screen element secured over a display device comprising a touch screen button panel.

Those familiar with data processing devices and systems will appreciate that other basic electronic components will be included in gaming machine 100 such as a power supply, cooling systems for the various system components, audio amplifiers, and other devices that are common in gaming machines. These additional devices are omitted from the drawings so as not to obscure the present invention in unnecessary detail.

All of the elements 205, 206, 207, 208, 209, 210, and 211 shown in FIG. 2 are elements commonly associated with a personal computer. These elements may be mounted on (or connected to) a standard personal computer motherboard and housed in a standard personal computer housing which itself may be mounted in cabinet 101 shown in FIG. 1. Alternatively, the various electronic components may be mounted on one or more circuit boards housed within cabinet 101 without a separate enclosure such as those found in personal computers. Those familiar with data processing systems and the various data processing elements shown in FIG. 2 will appreciate that many variations on this illustrated structure may be used within the scope of the present invention. For example, since serial communications are commonly employed to communicate with a touch screen controller such as touch screen controller 217, the touch screen controller may not be connected on system bus 208, but instead include a serial communications line to serial interface 211, which may be a USB controller or a controller supporting some other serial communication standard for example. It will also be appreciated that some of the devices shown in FIG. 2 as being connected directly on system bus 208 may in fact communicate with the other system components through a suitable expansion bus. Audio controller 209, for example, may be connected to the system via a PCI or PCIe bus. System bus 208 is shown in FIG. 2 merely to indicate that the various components are connected in some fashion for communication with CPU 205 and is not intended to limit the invention to any particular bus architecture. Numerous other variations in the gaming machine internal structure and system may be used without departing from the principles of the present invention. For example, a gaming machine in some embodiments of the present invention may rely on one or more data processors which are located remotely from the gaming machine itself. Embodiments of the present invention may include no processor such as CPU 205 or graphics processors such as 215 and 216 at the gaming machine, and may instead rely on one or more remote processors. Thus unless specifically stated otherwise, the designation "gaming machine" is used in this disclosure and the accompanying claims to designate a system of devices which operate together to provide the indicated functions. A "gaming machine" may include a gaming machine such as gaming machine 100 shown in FIGS. 1 and 2, which is itself a system of various components, and may also include one or more components remote from a gaming machine cabinet (that is, remote from cabinet 101 in FIG. 1). Thus the designation "gaming machine" encompasses both a stand-alone gaming machine and a gaming machine (that is, the part housed in a cabinet such as cabinet 101 in FIG. 1) along with one or more remote components for providing various functions (such as generating outcomes for plays in a game, and driving display devices mounted in the gaming machine cabinet).

It will also be appreciated that graphics processors are also commonly a part of modern computer systems. Although separate graphics processor 215 is shown for controlling primary video display device 104 and secondary video display device 107, and graphics processor 216 is shown for controlling both auxiliary display devices 108 and 109, CPU 205 or a graphics processor packaged with or included with CPU 205 may control all of the display devices directly without any separately packaged graphics processor. The invention is not limited to any particular arrangement of processing devices for controlling the video display devices included with gaming machine 100. Also, a gaming machine implementing the present invention is not limited to any particular number of video display devices or other types of display devices.

In the illustrated gaming machine 100, CPU 205 executes software, that is, program code, which ultimately controls the entire gaming machine including the receipt of player inputs and the presentation of the graphics or information displayed according to the invention through the display devices 104, 107, 108, and 109 associated with the gaming machine. CPU 205 also executes software related to communications handled through network controller 210, and software related to various peripheral devices such as those connected to the system through audio controller 209, serial interface 211, and touch screen controller 217. CPU 205 may also execute software to perform accounting functions associated with game play and execute bet configuration program code to implement the bet configuration and activation functions described below. Random access memory 206 provides memory for use by CPU 205 in executing its various software programs while the nonvolatile memory or storage device 207 may comprise a hard drive or other mass storage device providing storage for game software such as program code 204 (which may include pay tables and other tables or data such as the templates and bet configuration-specific data described below in connection with FIGS. 18A-B and 19A-B to implement the configurability facilitated according to the present invention) prior to loading into random access memory 206 for execution, or for programs not in use or for other data generated or used in the course of gaming machine operation. Network controller 210 provides an interface to other components of a gaming system in which gaming machine 100 may be included. An example network will be described below in connection with FIG. 3.

It should be noted that the invention is not limited to gaming machines employing the personal computer-type arrangement of processing devices and interfaces shown in example gaming machine 100. Other gaming machines through which the invention may be implemented may include one or more special purpose processing devices to perform the various processing steps for implementing the invention. Unlike general purpose processing devices such as CPU 205, which may comprise an Intel Pentium® or Core® processor for example, these special purpose processing devices may not employ operational program code to direct the various processing steps.

The example gaming machine 100 is shown in FIG. 2 as including user interface devices 220 (part of a player input system) connected to serial interface 211. These user interface devices may include various player input devices such as mechanical buttons shown on button panel 106 in FIG. 1, and/or levers, and other devices. It will be appreciated that the interface between CPU 205 and other player input devices such as player card readers, voucher readers or printers, and other devices may be in the form of serial communications. Thus serial interface 211 may be used for those additional devices as well, or the gaming machine may include one or more additional serial interface controllers. However, the interface between peripheral devices in the gaming machine, such as player input devices, is not limited to any particular type or standard for purposes of the present invention.

Reel Assembly 213 is shown in the schematic representation of FIG. 2 to illustrate that a gaming machine which may be used for various embodiments of the present invention may include mechanical reels. For example, a number of sets of mechanical reels may replace the primary display device 104, or at least part of that display device. Alternatively, mechanical reels may be included in the gaming machine behind a light-transmissive video display panel. In either case, the mechanical reels represent a display device for displaying various game symbols in the course of a game play. Although the invention is not limited to any particular mechanical reel arrangement or control system, mechanical reels may be controlled conveniently through serial communications which provide instructions for a respective stepper motor for each reel. Thus some embodiments of the present invention which employ mechanical reels may use a serial interface device such as serial interface 211 to control communications with the reel assembly, and may not include a direct bus interconnection as indicated by FIG. 2. Details of a mechanical reel arrangement and various accent lighting arrangements which may be associated with mechanical reels are not shown in the present figures so as to avoid obscuring the present invention in unnecessary detail.

Figure 3:
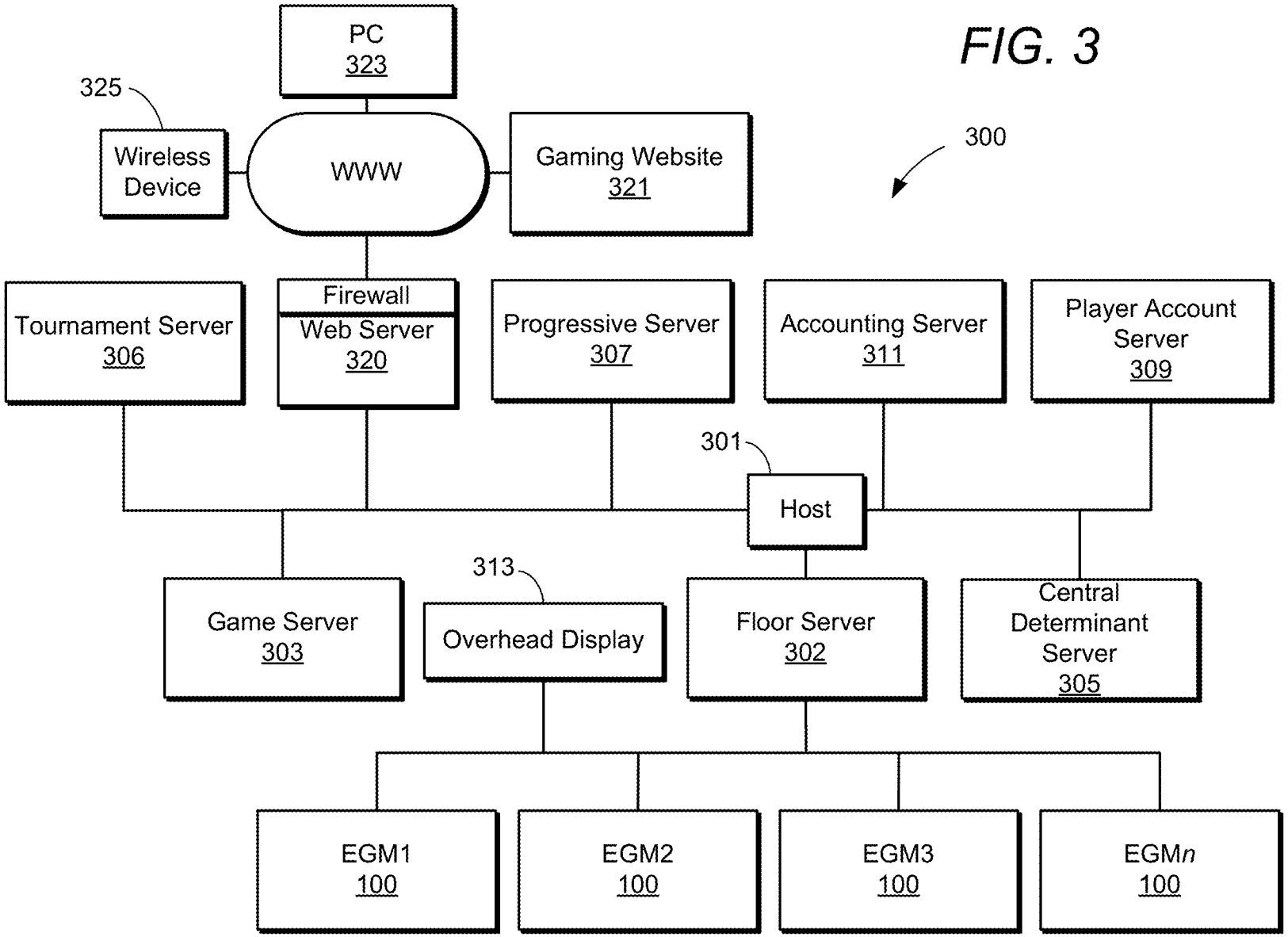
FIG. 3 is a schematic representation of a gaming network in which the present invention may be implemented.
Figure 4:
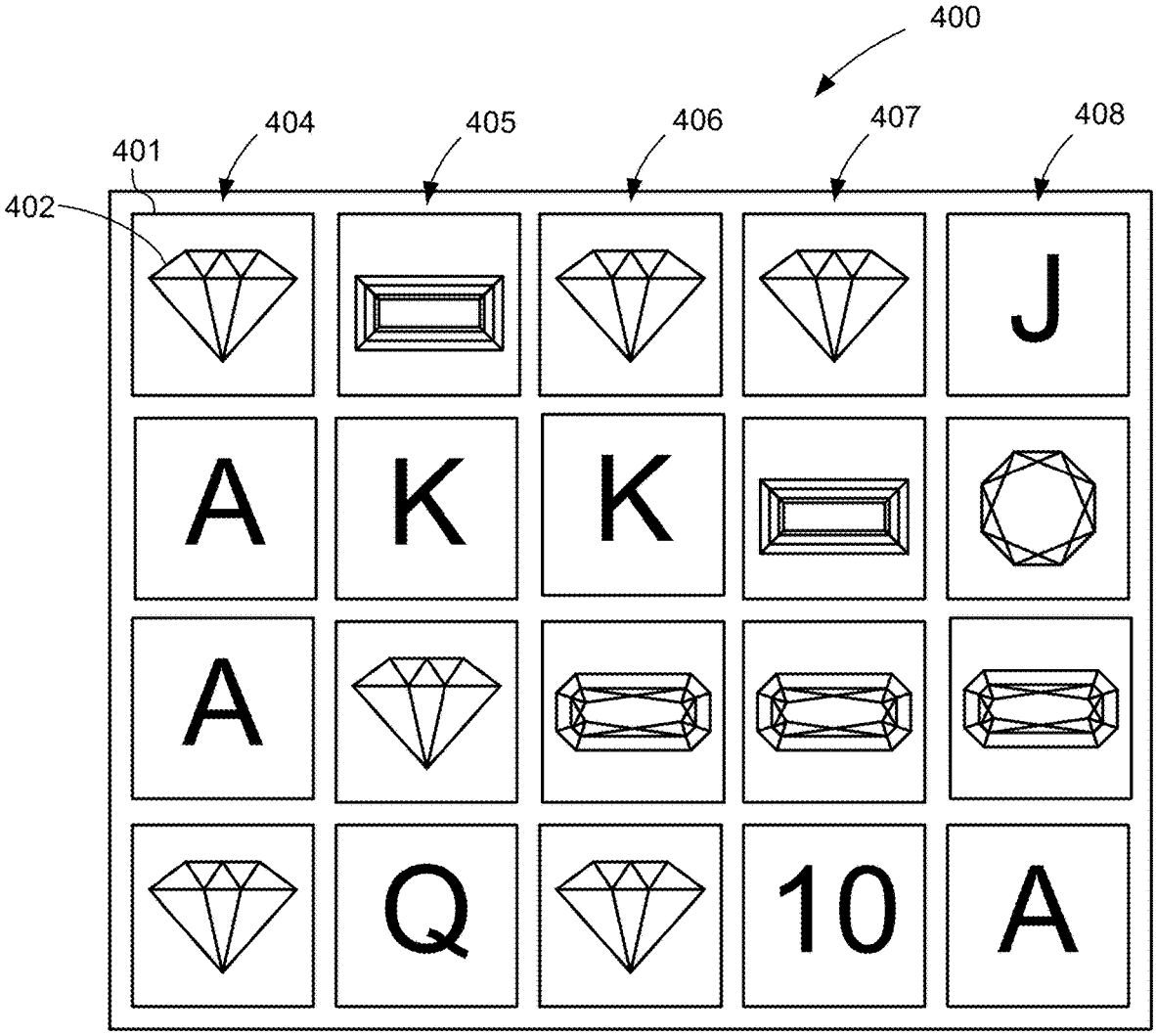
FIG. 4 is a representation of a game presentation of a type which may be used to display results in a gaming machine according to one or more embodiments of the present invention.

Referring now to FIG. 3, a networked gaming system 300 associated with one or more gaming facilities may include one or more networked gaming machines 100 ("electronic gaming machines" or "EGM's") connected in the network by suitable network cable or wirelessly. Networked gaming machines 100 (EGM1-EGMn) and one or more overhead displays 313 may be operatively connected so that the overhead display or displays may mirror or replay the content of one or more displays of gaming machines 100. For example, the primary display content for a given gaming machine 100 (including a game play according to the present invention) may be transmitted through network controller 210 to a controller associated with the overhead display(s) 313. In the event gaming machines 100 have cameras installed, the respective player's video images may be displayed on overhead display 313 along with the content of the player's gaming machine display.

The example gaming network 300 shown in FIG. 3 includes a host server 301 and floor server 302, which together may function as an intermediary between floor devices such as gaming machines 100 and back office devices such as the various servers described below. Game server 303 may provide server-based games and/or game services to network-connected gaming devices such as gaming machines 100. Central determinant server 305 may be included in the network to identify or select lottery, bingo, or other centrally determined game outcomes and provide the outcome information to networked gaming machines 100 which present the games to players.

Tournament server 306 may be included in the system for controlling or coordinating tournament functions. These functions may include maintaining tournament player scores and ranking in real time during the course of tournament play, and communicating this information to the various gaming machines 100 participating in the tournament and to overhead display 313. Tournament server 306 may also function to enroll players in tournaments, schedule tournaments, and maintain the time remaining in the various tournaments.

Progressive server 307 may maintain progressive pools for progressive games which may be available through the various gaming machines 100. In some implementations, progressive server 307 may simply receive communications indicating contribution amounts which have been determined by processes executing at the various gaming machines 100 or elsewhere in the gaming network. Alternatively, progressive server 307 may perform processes to determine the contribution amounts for incrementing the various progressive pools which may be maintained. Progressive server 307 may also periodically communicate current pool values back to the various gaming machines 100, and may participate in communicating awarded progressive prize amounts to the gaming machines and may make adjustments to the progressive prize pools accordingly. In some implementations, progressive server 307 may also determine or participate in determining when a progressive prize triggering event occurs.

Accounting server 311 may receive gaming data from each of the networked gaming devices, perform audit functions, and provide data for gaming analysis programs. Player account server 309 may maintain player account records, and store persistent player data such as accumulated player points and/or player preferences (for example, game personalizing selections or options).

Example gaming network 300 also includes a gaming website 321 which may be hosted through web server 320 and may be accessible by players via the Internet. One or more games may be displayed as described herein and played by a player through a personal computer 323 or handheld wireless device 325 (for example, a tablet computer, Apple® iPhone® or other smart phone, personal digital assistant (PDA), etc.). To enter website 321, a player may log in with a user name that may, for example, be associated with the player's account information stored on player account server 309. Once logged in to website 321 the player may play various games on the website, including games according to the invention. Also, website 321 may allow the player to make various personalizing selections and save the information so it is available for use during the player's next gaming session at a casino establishment having the gaming machines 100.

It will be appreciated that gaming network 300 illustrated in FIG. 3 is provided merely as an example of a gaming network in which configurable games according to embodiments of the present invention may be implemented, and is not intended to be limiting in any way. The invention is not limited to use in games offered through a gaming network (via the gaming website 321, or via gaming machines such as gaming machines 100, or otherwise). For example, a gaming machine configured according to one or more embodiments of the present invention to facilitate multiple different minimum bet configurations may comprise a standalone gaming machine having a configuration similar to gaming machine 100 or having any other gaming machine configuration. Also, when bet configuration systems as described herein are offered through gaming machines included in a gaming network, the network need not have the configuration shown for purposes of example in FIG. 3. In particular, servers shown separately in the example of FIG. 3 may be combined in a single physical processing device, or the processing duties of the various illustrated servers may be split into additional physical devices.

FIG. 4 shows a matrix 400 of gaming symbol locations 401 which may be used to display gaming results in underlying games employed in configurable gaming machines according to the present invention. Matrix 400 includes five symbol location columns 404, 405, 406, 407, and 408, which may each be defined by a respective video or mechanical reel, for example. The five symbol location columns together define four rows of gaming symbol locations 401 to provide a 4×5 matrix of symbol locations 401, each populated for a play of the game by a symbol such as symbol 402. It will be appreciated that numerous different symbol location patterns may be defined through the matrix 400, and a winning result in the game may be defined as a certain combination of one or different types of game symbols along a respective symbol location pattern. These symbol location patterns are commonly referred to as "paylines" in reel-type games, however, the patterns may be irregular and may not in fact trace a "line." Also, winning symbol patterns may be defined without regard to any geometric pattern. For example, a winning symbol pattern in a pay table employed in the present invention may comprise a "scatter pay" in which one or more types of game symbols are present in a populated matrix and are not necessarily aligned in any predefined pattern.

Embodiments of the present invention provide a configuration structure which allows a given slot game (that is, a game showing results via a matrix such as the example in FIG. 4) to be configurable to provide a variety of different options for minimum bet. The user (casino personnel or perhaps a player) may select one of these minimum bets for the bet configuration to be applied in a given play at the gaming machine.

The present invention may be embodied in a gaming machine implementing an underlying slot game with a given math design that plays with a specific minimum bet and has specific pay table values. For this given math design (which includes pay table values, probabilities of winning each pay table value, and all rules of the game and physical characteristics affecting the probability at any level) implementations of the present invention employ different bet configurations created by multiplying all pay table values in the game by some fixed mathematical ratio, and multiplying the minimum bet for the game by that same ratio for each bet configuration. The ratio, which may also be referred to as a "translation ratio" or "translating ratio" is selected so that all pay table values (and the new bet value) come out to whole numbers. This manner of producing an additional bet configuration assures that the underlying game played at the additional bet configuration provided by applying the translation ratio has the same payout percentage (and essentially all other math statistics identical as well) but playing at a different minimum bet. Each additional bet configuration produced by applying a respective translation ratio may be stored and then applied as desired through a gaming machine to allow players to play the same slot game (with the give rules of play, volatility, and other characteristics) but at different stakes without changing the denomination for the game.

In one implementation, the game math is first designed with a minimum bet of 50 credits, making sure that all pay table values (including possible bonus award values and other special award values) are multiples of 5. From this first minimum bet and corresponding pay table, combination versions of the game may be generated with, for example, respective minimum bets of 10, 20, 30, and 40 credits (in addition to originally designed 50 credits), by multiplying all pay table values by ⅕, ⅖, ⅗, and ⅘, respectively. These combinations of minimum bet and corresponding pay table may be stored in suitable data storage associated with or accessible to the gaming machine. A selection of a minimum bet by the user configuring the gaming machine effectively selects the pay table necessary to implement the underlying game with the designed play characteristics, and the data is retrieved by the gaming machine processing device(s) and used to configure the gaming machine accordingly to place the bet configuration in the active state. The retrieval of bet configuration data and configuration of the gaming machine will be described further below in connection with FIGS. 5 and 14-18B.

In a further embodiment, a game may be developed for a bet of 50 credits as noted above, and then all pay table values may be multiplied by ½ to translate the game to a minimum bet of 25 credits. To allow this method of converting to a minimum bet of 25 credits and also the method above to convert to 10/20/30/40, all pay table values must be multiples of 10 (least common multiple of 2 and 5). Thus any game that can be arranged to have all pay table values multiples of 10 can be employed in the present invention to offer minimum bet options of 10, 20, 25, 30, 40, and 50. The bet configuration data at each minimum produced according to this translation are stored and this data may be retrieved to configure a gaming machine according to the bet configuration.

It is noted that the above arrangement of translating a given pay table for a given minimum bet to additional minimum bet and pay table combinations does not change the number the winning symbol location patterns (paylines or scatter pays) defined for the game. The same number of winning symbol location patterns may be used for each combination of minimum bet and corresponding pay table. Furthermore, the different minimum bet and corresponding pay table combinations are at the same denomination. That is, the denomination of the game does not change for the different minimum bet and corresponding pay table combinations. Furthermore, the translated minimum bet and pay table values may be readily scalable with bet multipliers to provide different bet levels in addition to the minimum bet level. A given bet configuration may thus include not only the pay table and minimum bet but also a sequence of bet multipliers (or the resulting products) that provide multiple bet levels for the pay table as will be described below particularly in connection with FIGS. 17A-B and 18A-B.

As noted above, the application of a translation ratio to produce a different minimum bet for a given game design and to produce the corresponding pay table values for the different minimum bet, maintains all of the play characteristics of the given game design, including payout percentage. However, implementations of the invention may employ pay tables designed in different payout percentages, and a user may be allowed to select a desired payout percentage for the minimum bet level in a given bet configuration and also select different payout percentages for other, higher bet levels in the bet configuration.

Figure 5:
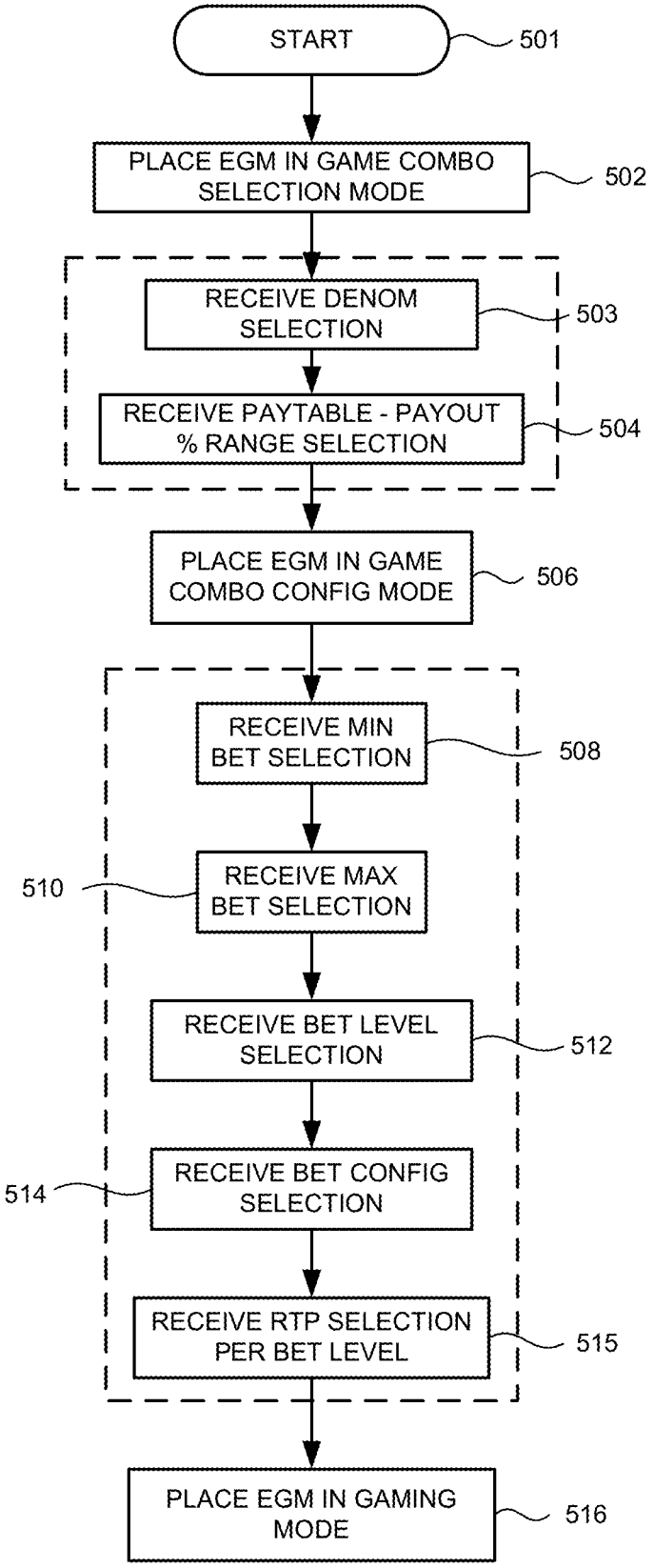
FIG. 5 is a flow diagram illustrating process steps according to one example embodiment of a gaming machine configuration process according to the present invention.

FIG. 5 comprises a process flow diagram showing an example process within the scope of the present invention. The process shown in FIG. 5 is particularly adapted for a user comprising a casino operator who configures a gaming machine ("EGM" or "electronic gaming machine" such as 100 in FIG. 1) prior to placing the gaming machine into operation. However, the invention is not limited to casino operator configuration of a gaming machine. Rather, a player may also be able to configure a gaming machine at least as to some aspects which are configurable according to the invention. In any event, the various process steps shown in FIG. 5 will be described below in connection with the following discussion of the example user interfaces of FIGS. 6-14.

A prior art gaming machine may be configured with math data that describes a fixed, limited set of bet configurations. The only choices a casino has in configuring such a standard gaming machine is choosing a denomination (commonly referred to as "denom") for the game, or possibly multiple denominations if multiple denominations are supported by the game design, and then associating a pay table with each selected denom. The fixed set of bet configurations apply to all denomination/pay table combinations, so the minimum bet in credits, number of bet levels, and bet multipliers are the same for all denominations.

However, by storing pay table and minimum bet data in accordance with the present invention as described above, a large set of bet configurations may be supported, including various minimum bet and bet multiplier combinations. Denominations and associated pay table combinations are still selected, but particularly if the gaming machine has configurable bet buttons such as bet buttons on a touch-screen display so the number of buttons and button labels can be changed dynamically, then the gaming machine may be configured from the full set of allowed bet configurations, and with different bet configurations for each denomination/pay table combination. Button panels employing physical bet buttons (that is, buttons that are not implemented on a video display device) may be used in implementations of the invention where sufficient physical bet level buttons are available and different buttons may be selectively activated for a game. For example, physical bet level buttons which are active for a given play may be illuminated differently (different colors, intensity, or effects such as flashing) from the buttons that are not active for the play. Note a gaming machine with a single set of static (always active) physical bet buttons may employ a stored bet configuration developed as described above provided the bet configuration calls for bet levels corresponding those indicated (labelled) for the physical bet buttons. In this case, the gaming machine configuration is simply constrained to the bet configuration corresponding to the static physical bet buttons.

The game-specified data for default and allowed bet configuration may be described as a set of allowed minimum bet values and a set of bet multiplier sequences. From this, the number of bet levels available for a play at the gaming machine configured with this data is the length of a bet multiplier sequence, and the maximum bet is the minimum bet multiplied by the largest bet multiplier. A bet configuration sequence comprises each bet multiplier multiplied by a minimum bet value.

FIGS. 6-14 may be used to describe how a gaming machine according to the present invention may be configured by a user (typically a casino employee but potentially a player). The configuration screens shown in FIGS. 6-14 may be presented at a suitable display device of the gaming machine, such as primary display 104 of gaming machine 100 shown in FIG. 1 by executing bet configuration program code to place the gaming machine in the various configuration modes described below. Alternatively, the bet configuration may be done remotely and the resulting configuration data or definitions for the configuration data may be communicated to the gaming machine for use in connection with plays of a game through the gaming machine.

Figure 6:
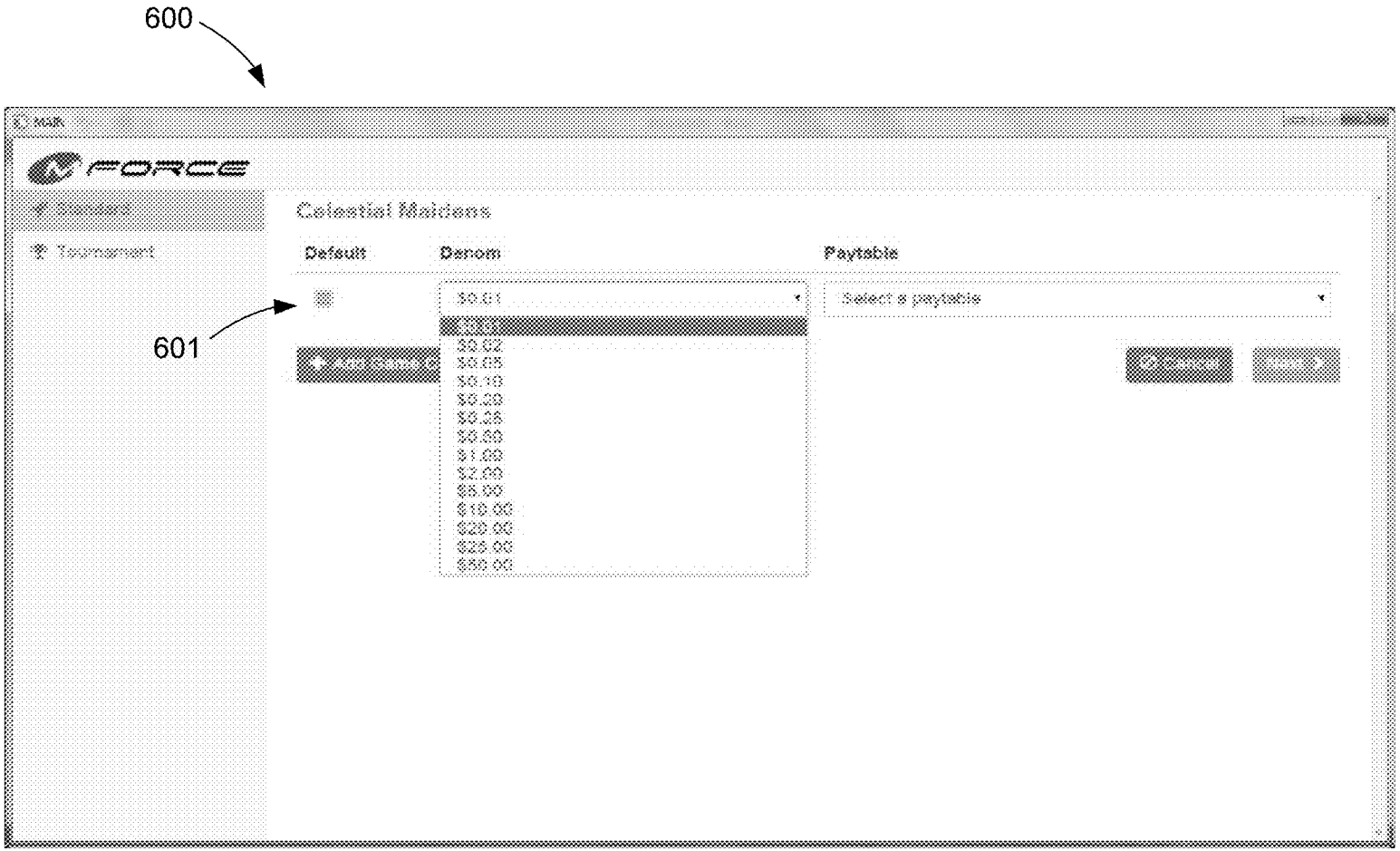
FIG. 6 is a representation of a user interface of a game combination ("combo") selection mode which may be displayed in accordance with the method shown in FIG. 5.

FIG. 6 shows an initial screen 600 in the game combination ("combo") selection mode (502 in FIG. 5), in this illustrated case for a game identified as "Celestial Maidens." In the state of the initial screen shown in FIG. 6, the "Denom" (denomination) field for the first-row combination 601 has been selected with a pointing device or other control to cause the display device to show a drop-down menu of different denominations available for this configuration.

Figure 7:
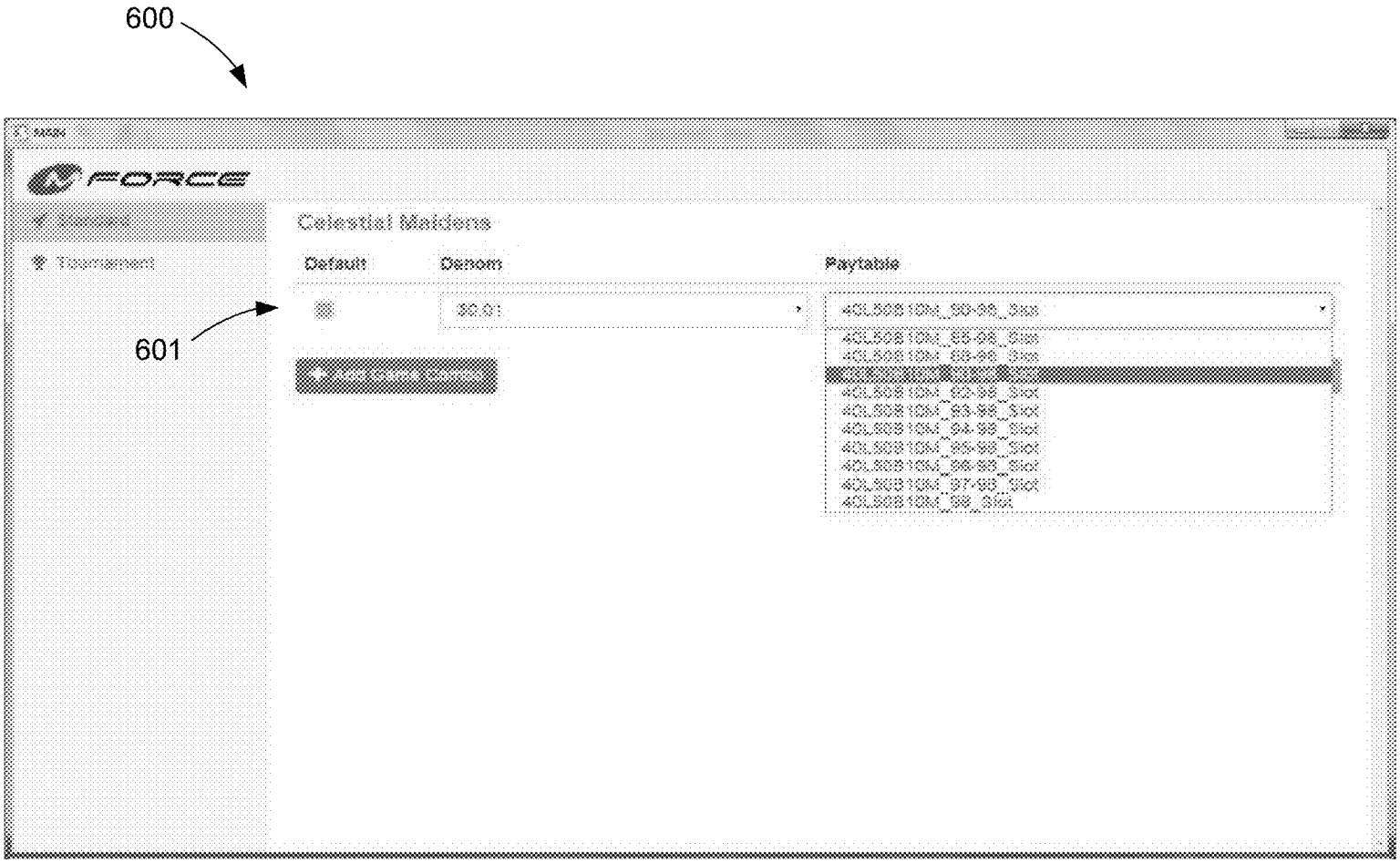
FIG. 7 is a representation of the user interface shown in FIG. 6 after certain selections have been made for a wagering game.

FIG. 7 shows the initial screen of the game combination selection mode after the denomination has been selected for the first-row combination 601 and the "Paytable" field has been selected to show a drop-down menu of available pay tables which may be selected. Many of the pay table selections available in this example include a range of payout percentages which may be selected as will be described below. The pay table highlighted in FIG. 7 provides a range of payout percentage of nominally 90 to 98 percent as indicated in the pay table identifier. From this illustrated point in the game combination selection mode, invoking the "Add Game Combo" button (virtual button displayed on the display screen) inserts a new game combination row on the page in addition to any previously added rows.

Figure 8:
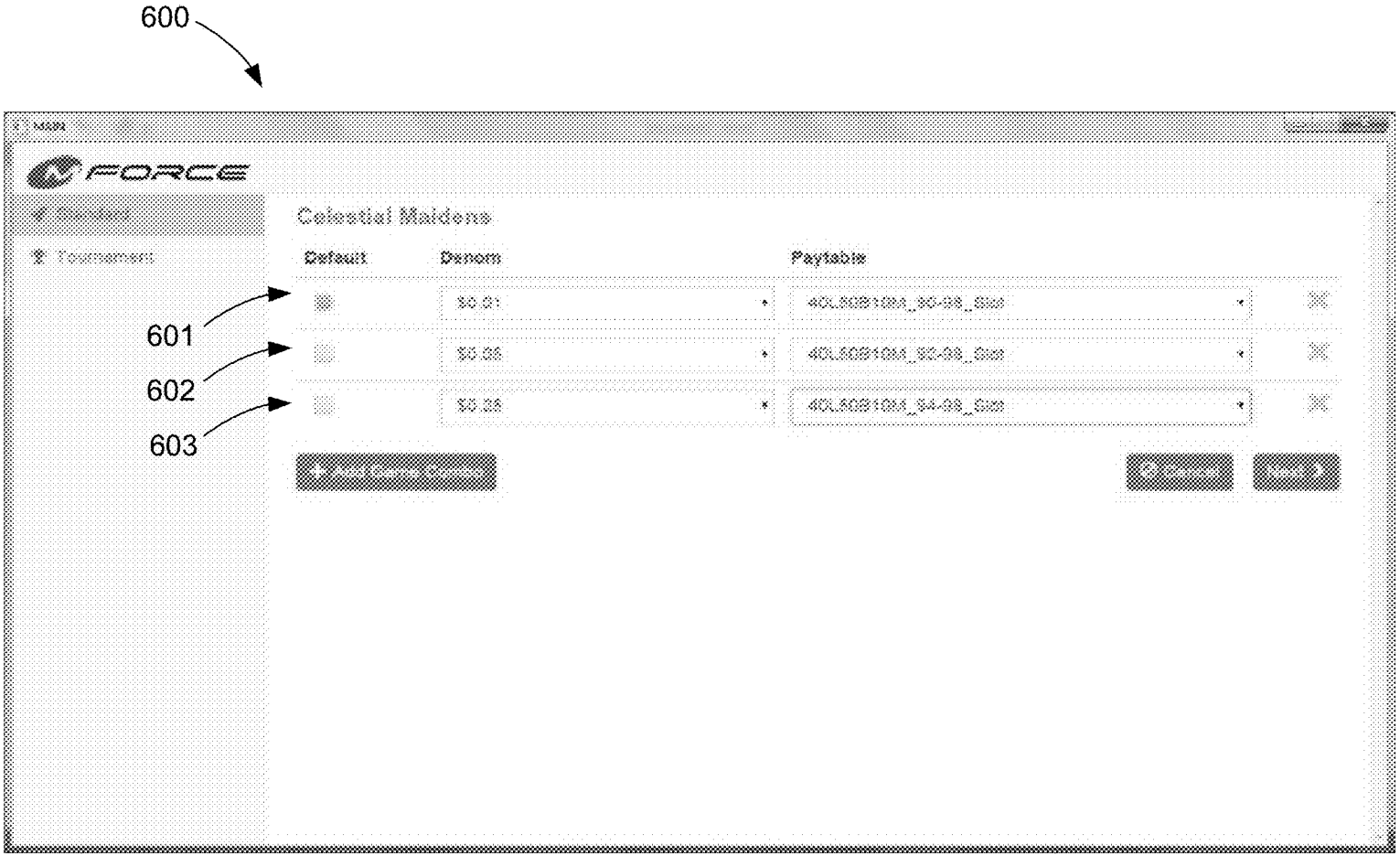
FIG. 8 is a representation of the user interface shown in FIG. 6 after selections have been made for three game combinations.

FIG. 8 shows a condition after the state shown in FIG. 7 in which that the "Add Game Combo" button has been invoked twice to add two additional rows 602 and 603 to provide a final total of three different game combinations which have been fully configured with denomination and pay table selections. For each game combination a denomination selection was received as shown at 503 in FIG. 5 and a pay table/payout percentage range selection was also received as shown at 504. Once at least one combination is configured and a default configured combination selected, the "Next" button is enabled so that it may be selected by the user. Invoking the "Next" button in this embodiment results in the EGM being placed in game combination configuration or bet configuration mode, which is the step shown at 506 in FIG. 5.

Figure 9:
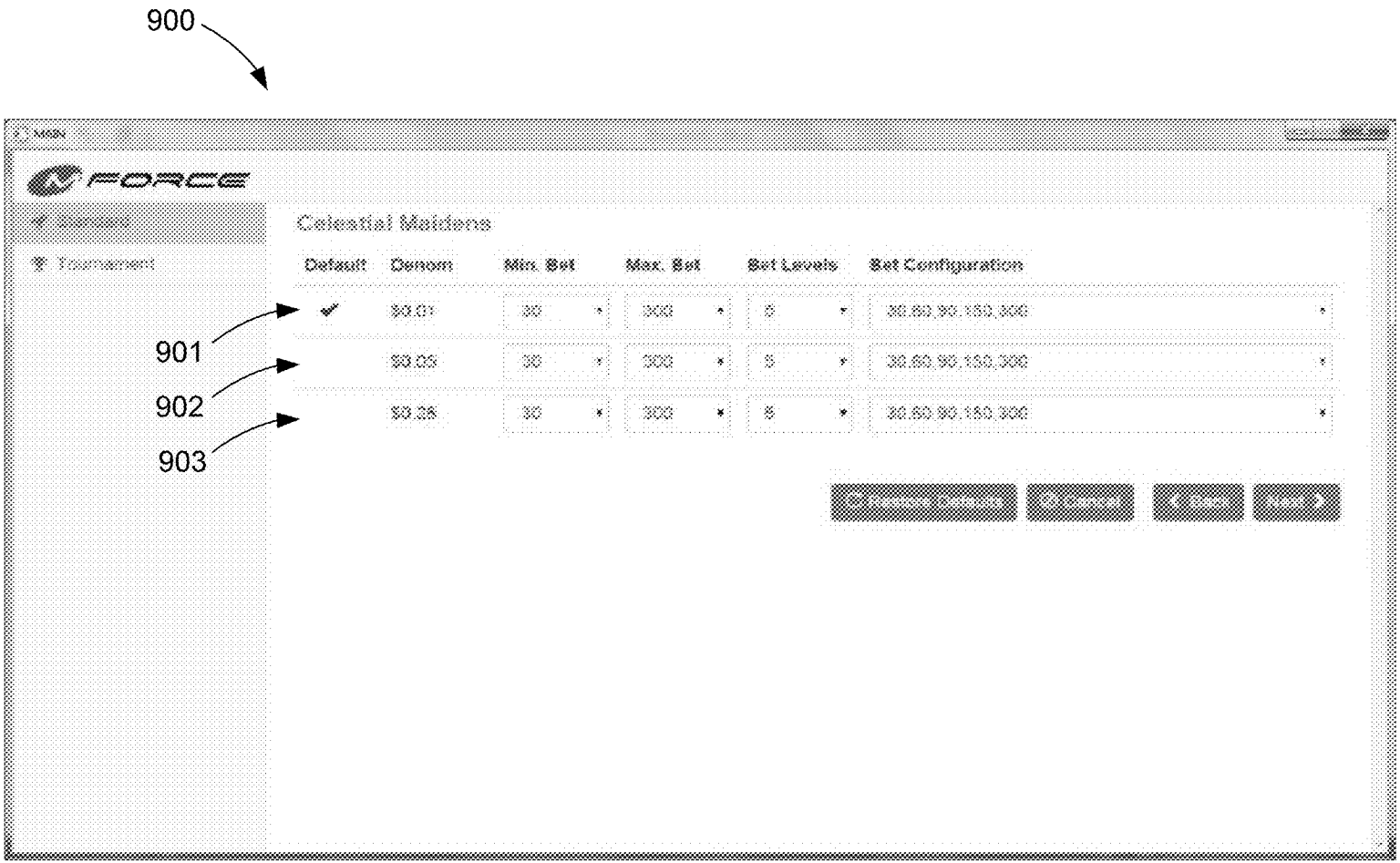
FIG. 9 is a representation of a user interface which may be produced for a game combination configuration mode for the process shown in FIG. 5.

FIG. 9 shows an example game combination configuration screen (user interface) 900 displayed at the gaming machine or remote configuration terminal shown after the "Next" button on the game combination selection screen 600 in FIG. 8 is invoked. All the rows 901, 902, and 903 (corresponding to the rows 601, 602, and 603 in FIG. 8) show a default bet configuration specified by the game in this example. This is the bet configuration that would be used if the game was installed on an EGM with static/unalterable physical bet buttons labeled for the default bet configuration. All of the data on this screen is derived from default minimum bet value of 30 and bet multiplier sequence of 1, 2, 3, 5, 10.

Figure 10:
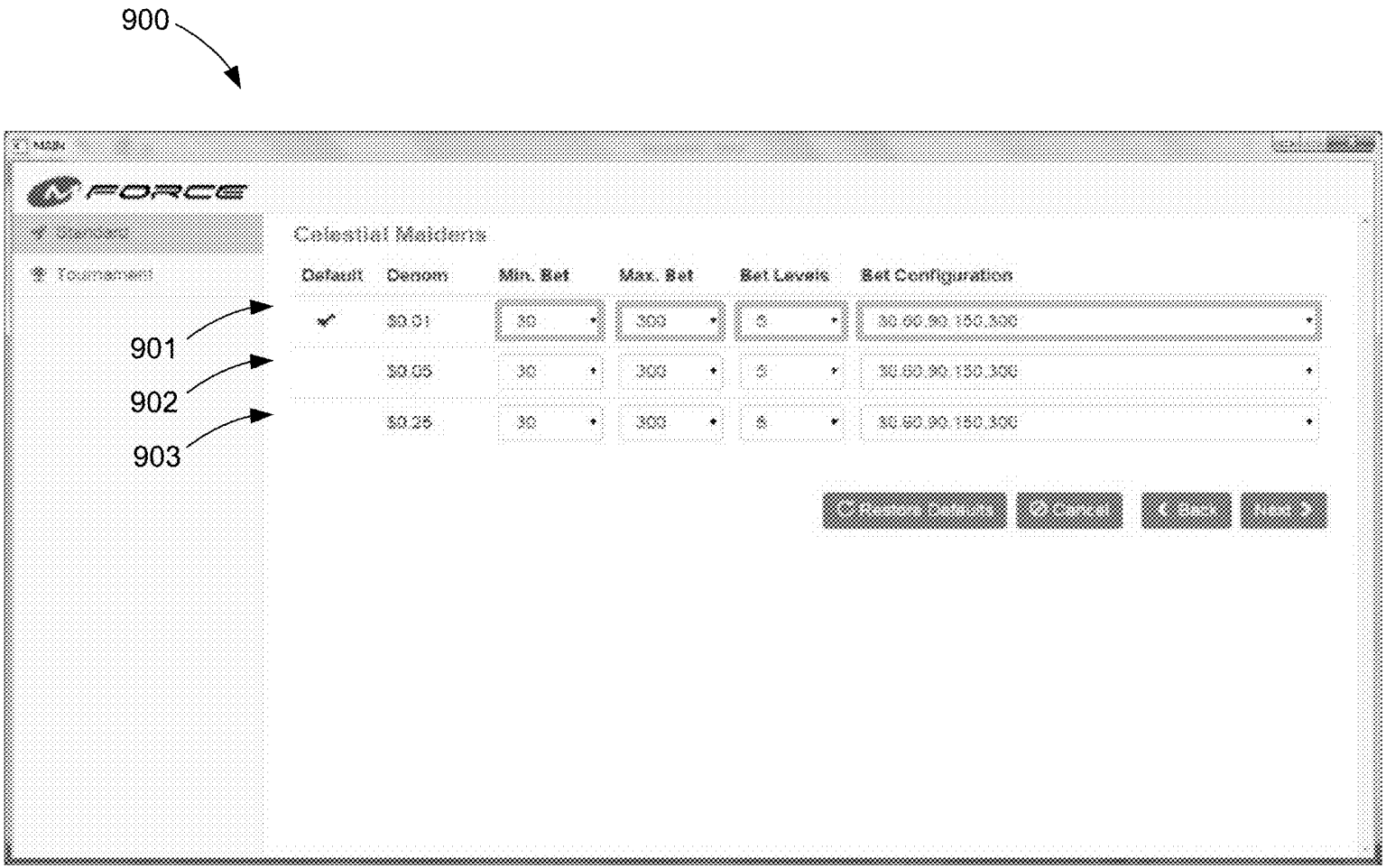
FIG. 10 is a representation of the user interface shown in FIG. 8 after a game combination has been selected for configuration.

FIG. 10 illustrates a state of the configuration screen 900 shown in FIG. 9 after the user has selected the first row 901 for configuration to modify one or more of the default values which have populated the various fields of the first row. Whenever an entry on a row is changed, all fields to the right on that row may be cleared. For example, on row 901, changing the "Min. Bet," that is, minimum bet (corresponding to 508 in FIG. 5) may cause the maximum bet ("Max. Bet"), bet levels, and bet configuration fields to be cleared. Each field may be selected to display a drop-down menu of available options for that field. For example, the minimum bets available for each row 901-903 may be 10, 20, 30, 40, or 50 credits selectable from the drop-down menu for the minimum bet field. A similar drop-down menu with available configuration options may be presented by selecting the maximum bet, bet levels, and bet configuration fields for a given row.

The bet configuration drop-down menu contents for a given field are preferably filtered by the selection made in the immediately preceding field to the left in the figures. For example, in the case where a minimum bet of 30, maximum bet of 300, and bet levels value of 6 are selected in a given row, the available bet configurations (which may be selected according to 514 in FIG. 5) will be a subset of the total number of designed bet configurations that have the specified minimum bet of 30, the maximum bet of 300, and a sequence length matching the bet levels value of 6.

Selections in each field may also be filtered by jurisdictional limits such as maximum bet and payout constraints. The user interface preferably never presents a selection in a drop-down menu that would result in no possible final bet configuration.

Figure 11:
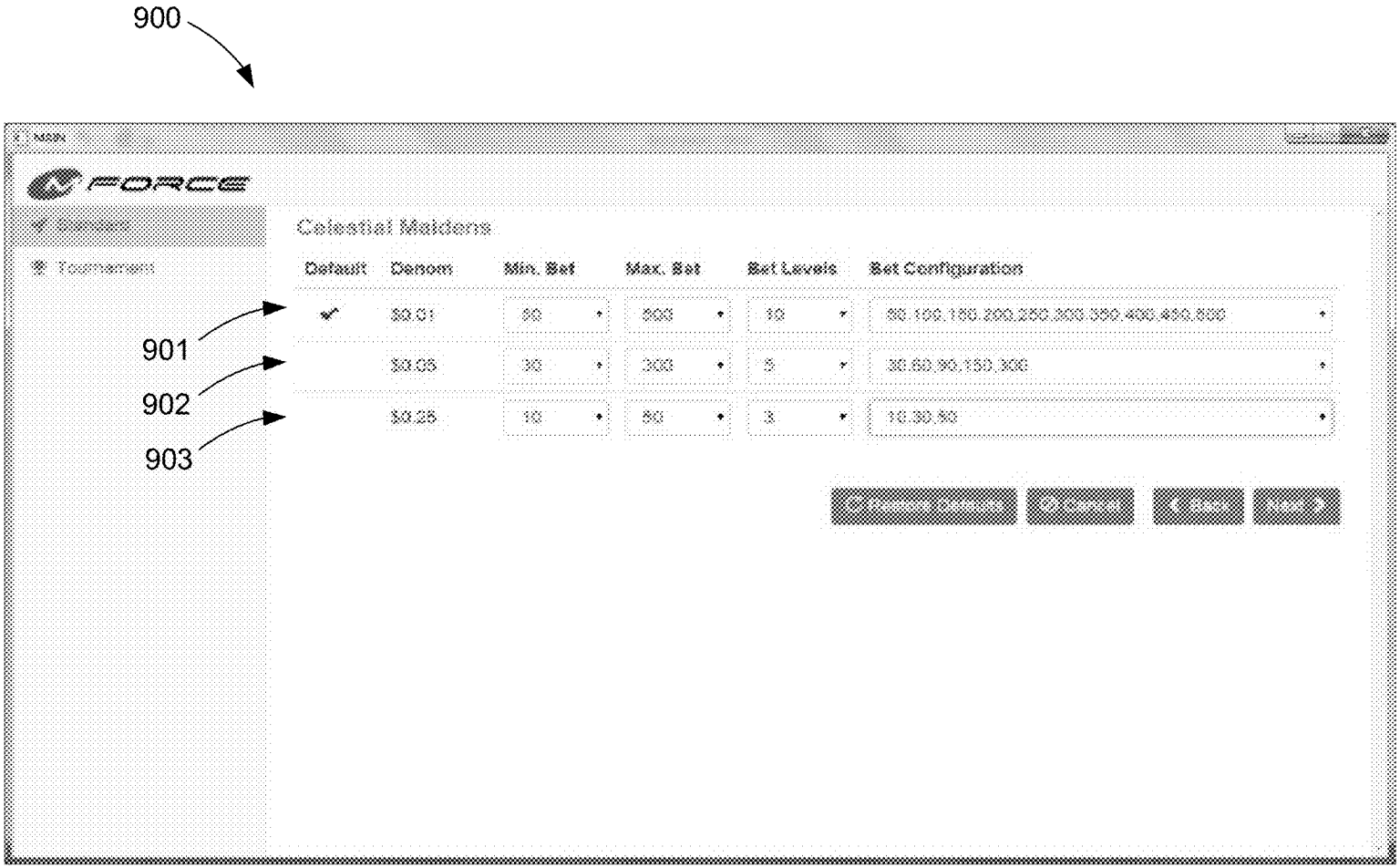
FIG. 11 is a representation of the user interface shown in FIG. 9 after bet levels have been configured for the three previously defined game combinations.

FIG. 11 shows a completed example of a gaming machine configuration according to the invention, with a completely different bet configuration for each denomination. The bet configuration selected for the configuration in the first (top) row 901 (a first bet configuration) is derived from the bet multiplier sequence 1, 2, 3, 4, 5, 6, 7, 8, 9, 10 (first configuration minimum bet=50 credits, first configuration maximum bet=500 credits, first configuration credit denomination=$0.01). The bet configuration selected for the configuration in the second row 902 (a second bet configuration) is derived from the bet multiplier sequence 1, 2, 3, 5, 10 (second configuration minimum bet=30 credits, second configuration maximum bet=300 credits, second configuration credit denomination=$0.05). The bet configuration selected for the configuration in the third (bottom) row 903 (a third bet configuration) is derived from the bet multiplier sequence 1, 3, 5 (third configuration minimum bet credits=10), third configuration maximum bet=50 credits, third configuration credit denomination=$0.25.

Figure 12:
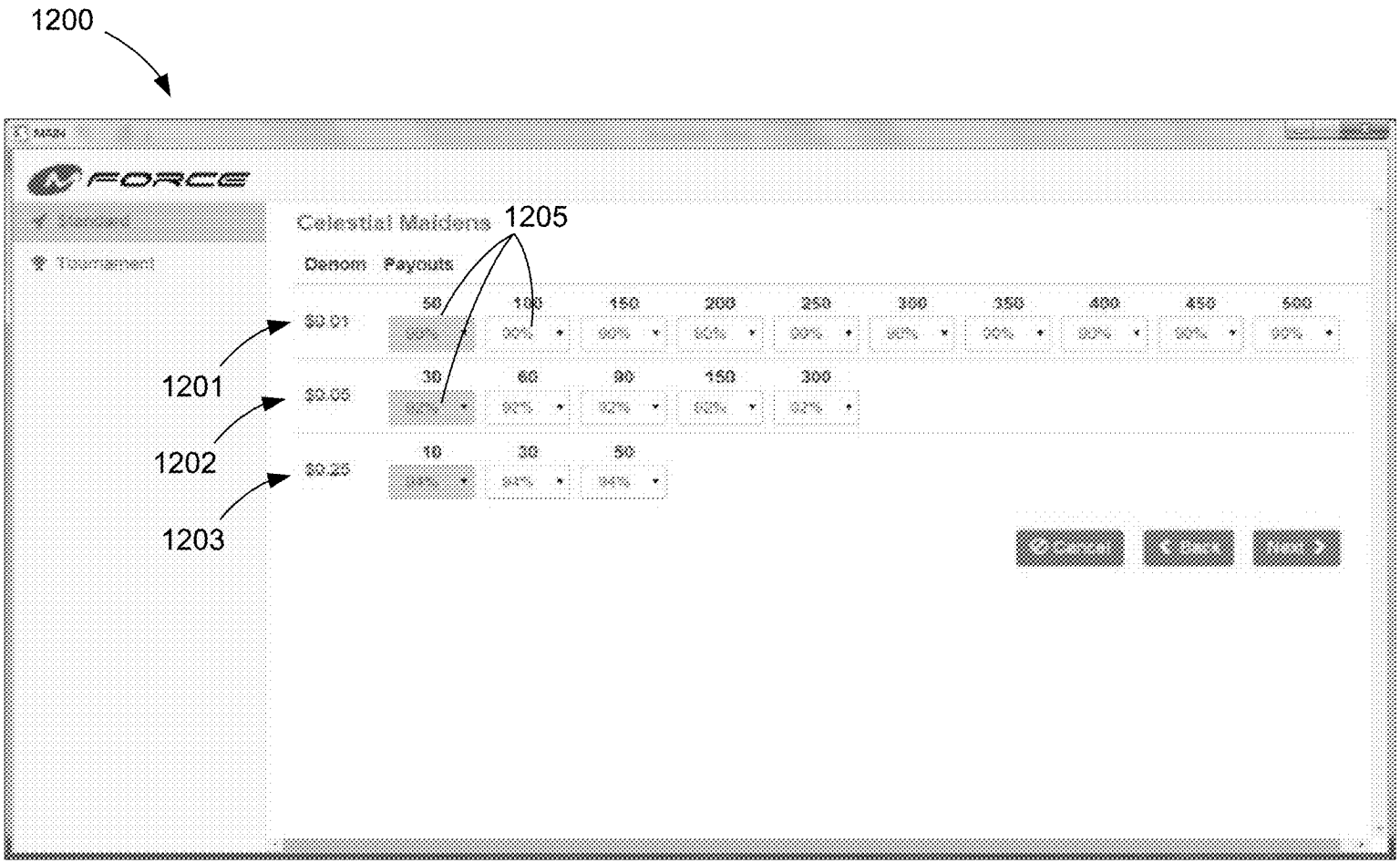
FIG. 12 is a representation of a user interface which may be produced for a payout percentage selection in the method shown in FIG. 5.
Figure 13:
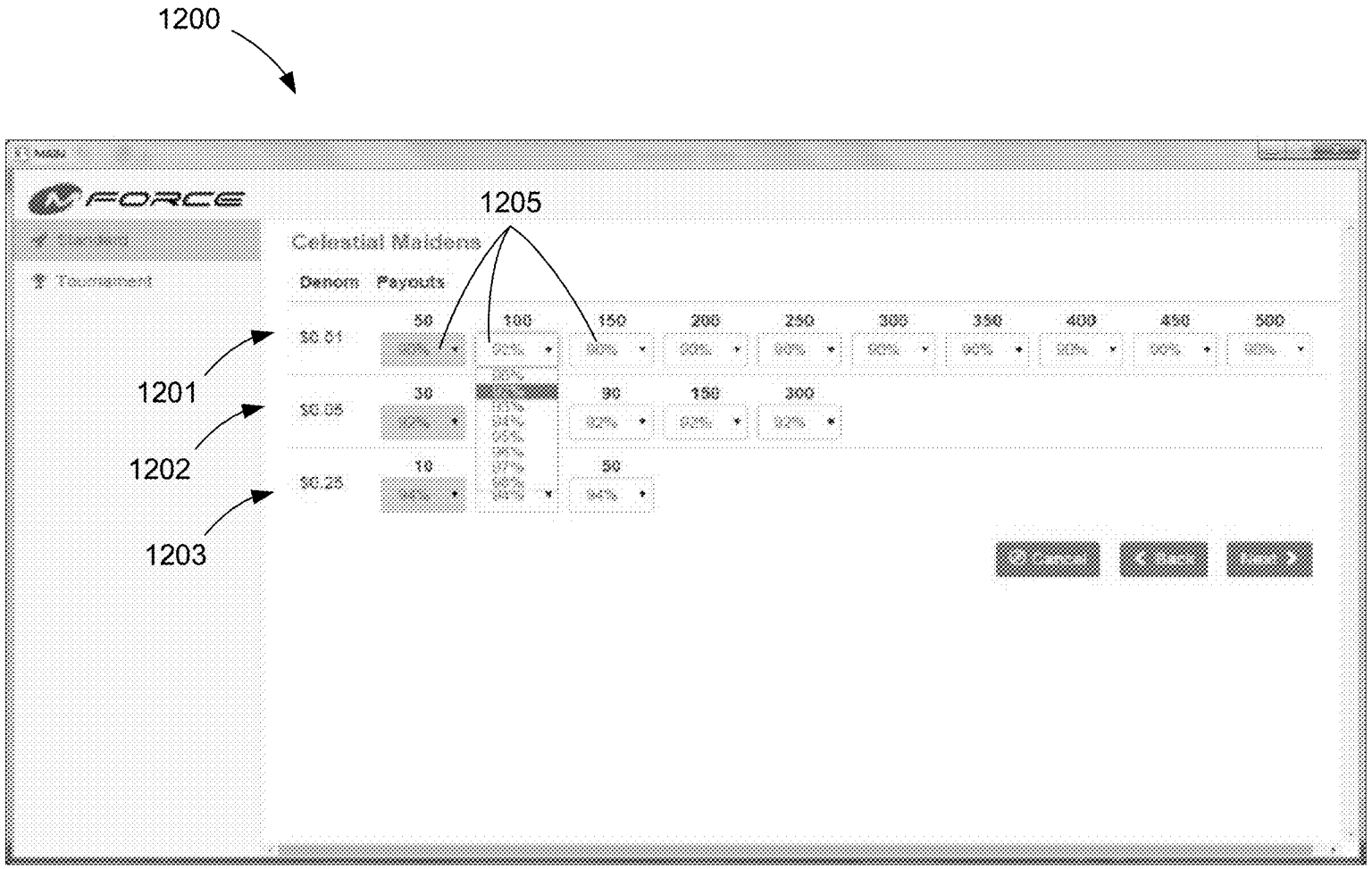
FIG. 13 is a representation of the user interface shown in FIG. 12 in the course of a selection of payout percentage for a particular bet level according to the invention.

Whenever all rows are complete on the interface display shown in FIG. 11, the "Next" button is enabled to allow the user to proceed to the payout percentage configuration screen 1200 shown in FIG. 12 in which payout percentage may be selected for each bet level which has previously been selected. In the example payout percentage selection screen 1200 shown in FIG. 12, rows 1201, 1202, and 1203 correspond to the rows 901, 902, and 903 in FIG. 11 and a column is provided for each bet level in each row. Each bet level for each bet configuration is displayed immediately above a respective payout percentage field 1205. In the state of the payout percentage configuration screen 1200 shown in FIG. 12, each payout percentage field 1205 has been automatically populated with the minimum payout percentage available for the pay table that has been selected for that bet configuration. Continuing with the illustrated example, the pay table selected for the configuration in row 1201 (corresponding to row 601 in FIG. 8) has a range of payout percentages from 90% to 98% and thus each field 1205 in row 1201 in FIG. 12 is populated with "90%." Likewise, the pay table selected for the configuration in the middle row 1202 (corresponding to row 602 in FIG. 8) has a range of payout percentages from 92% to 98% and thus each field 1205 in row 1202 in FIG. 12 is populated with "92%." Finally in this example, the pay table selected for the configuration in the bottom row 1203 (corresponding to row 603 in FIG. 8) has a range of payout percentages from 94% to 98% and thus each field 1205 in row 1203 in FIG. 12 is populated with "94%." In other implementations each payout percentage field 1205 may simply not be populated or populated with some other default value from the selected pay table. In any event, the user may select a particular available payout percentage in a given field 1205 by using a suitable control device to select the field. This selection of a given payout percentage field 1205 preferably causes a drop-down menu to appear adjacent to the field listing all of the available payout percentages available to be selected. For example, selecting the field 1205 associated with the minimum bet of 100 in the first row 1201 in FIG. 13 is shown as causing a drop-down menu to appear including 90%, 92%, 93%, 94%, 95%, 96%, 97%, and 98% as available for selection. As will be discussed below, these payout percentages available for a given pay table are expressed as nominal values and the actual payout percentages achievable with a given result probability design will typically be slightly different. The nominal values displayed for selection are sufficient for enabling the user to choose the desired approximate payout percentage for a given bet level.

Once a respective payout percentage has been selected for a respective payout percentage field 1205 in FIG. 13, the field background changes color in this particular implementation. Once a respective payout percentage has been selected for each respective field 1205, the "Next" button becomes active and may be invoked to move to the configuration summary screen 1400 shown for purposes of example in FIG. 14. This summary screen 1400 shows the configuration details for each game configuration shown in a respective row 1401, 1402, and 1403 in this example where three game combinations are configured. In particular, summary screen 1400 shows for each game configuration 1401, 1402, and 1403, a denomination column 1405, the pay table identifier column 1406, and a bet level and actual payout percentage column 1407 for each bet level of each of the bet configuration. The game configurations 1401, 1402, and 1403 shown in the example summary screen 1400 of FIG. 14 may be accepted and ultimately placed in an active state by placing the gaming machine in gaming mode as indicated at 516 in FIG. 5. In this state, the gaming machine (such as 100 in FIG. 1) applies the specified pay table and bet configuration for a given denomination to plays initiated at the gaming machine at that denomination. In this example, the denomination in effect for a given play and corresponding pay table and bet configuration is selectable by the player as will be described below in connection with FIGS. 31 and 32. A different game configuration or set of game configurations including bet configurations and payout percentage configurations selected as described above may be placed in the active state at the gaming machine by going through the process shown in FIG. 5 (and indicated by screens 600, 900, 1200, and 1400) again to produce a different game configurations and corresponding bet configurations.

It should be noted that implementations of the payout percentage selection process within the scope of the present invention may place limitations on the payout percentages that may be available at a given bet level. For example, some implementations may not allow a payout percentage to be selected for a given bet level that is lower than the payout percentage selected for the next lower bet level. That is, implementations may require that a payout percentage selected for a give bet level must be either equal to or higher than the immediately preceding bet level in the sequence. These implementations may restrict the payout percentages shown as available in the corresponding drop-down menu to enforce this payout percentage limitation.

Embodiments of the present invention encompass numerous variations on the bet configuration and payout percentage configuration process indicated by the example display screens of FIGS. 6-14 and the process shown in FIG. 5. For example, alternatively to the game combo selection mode at 502 in FIG. 5 and the combo configuration mode at 506 in FIG. 5, these modes could be combined into a single mode represented by a single display screen in which the operator/user could select denomination, minimum bet, maximum be, and number of bet levels to define the discrete bet levels selectable by a player in the game. The operator could then select a payout percentage for the minimum bet and the user interface could then automatically configure a progressively higher payout percentage for the remaining bet levels. Alternatively, an operator may be allowed to then select payout percentage individually for each bet level.

In embodiments where payout percentage may be selected for one or more bet levels in a given bet configuration, the variations in the payout percentage may be accomplished in any manner known in the art. For example, in some game designs the game result for a given play in a game is determined first and then the reels of the reel-type game are controlled to come to stop to show that game result. In these game designs, payout percentage for a given play may be varied by varying the probabilities associated with the various potential game play results. That is, for one or more potential results in a game, the probability of obtaining the result may be modified to be more or less likely to vary the payout percentage for the game. Selecting a particular payout percentage for a bet level in these game designs has the effect of selecting the set of result probabilities to be applied for the game play at the given bet level. In other game designs, the reels are randomly stopped and the probability of obtaining a given result in the game is determined by the number and types of symbols shown be each reel at the stop position. In these game designs, payout percentage may be varied by changing the number and/or types of symbols shown on one or more reels. The selection of an available payout percentage for a play at a give bet level in these game designs has the effect of selecting the reel strips to be used for a play at that bet level. Changing the number and/or types of symbols shown on a reel may be accomplished readily in video simulated reels or physical reels where game symbols are shown on video or other display devices mounted on the reels.

FIGS. 15-17 show how a configurable button panel (such as a touch screen implemented button panel for example) dynamically changes to reflect the current bet configuration for the current denomination. In some embodiments of the invention, the default denomination is selected initially, but the player can switch denominations during play at the gaming machine.

FIG. 15 shows the four virtual bet buttons (that is, touch screen implemented buttons) for a bet configuration having a minimum bet of 50 credits, and a bet multiplier sequence of 1, 2, 6, and 10. FIG. 16 shows the six virtual bet buttons for a bet configuration having a minimum bet of 30 credits, and a bet multiplier sequence of 1, 2, 4, 6, 8, and 10. FIG. 17 shows the ten virtual bet buttons for a bet configuration having a minimum bet of 10 credits, and a bet multiplier sequence of 1, 2, 3, 4, 5, 6, 7, 8, 9, and 10. In a typical implementation, a player may invoke one of the "Play X credits" buttons (where X is the specified value) to select that bet level for a play in the game, and may then be required to invoke a "Play" button or other control (not shown) to initiate a play of the game at the gaming machine. In each of the examples of FIGS. 15-17 the virtual button panel also includes a separate "Max Bet" button which places the respective maximum bet in play, without having to separately invoke a "Play" control.

Implementations of configurable games according to the invention may be unable to hardcode any bet configuration information. This includes pay table information and help text that depends on or must show actual bet configuration values. To accommodate this, gaming machines embodying the present invention may be configured to generate different pay table and help screens (that is, graphic arrangements generated on a suitable display device or system) that can be selected to display based on the active bet configuration, and that can have placeholders for which actual values are substituted at run time. In other words, implementations of the invention may make use of dynamic, code-generated pay table values to fill placeholder locations in pay tables and help text as a function of the bet configuration which is active at a given time. These arrangements will be discussed further below in connection with FIGS. 18A-B and 19A-B.

Figure 18A:
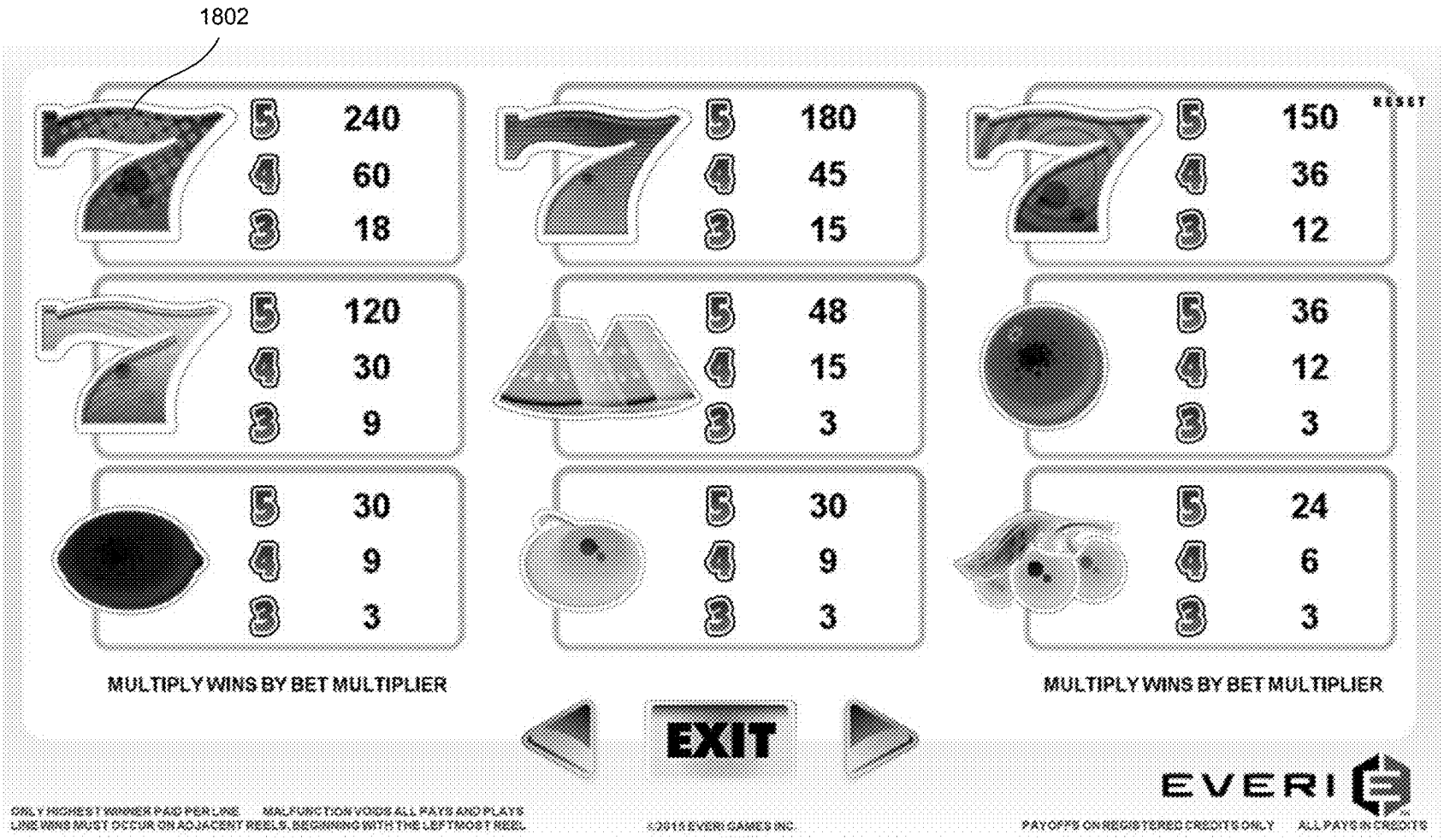
FIG. 18A is a representation of a pay table screen for a gaming machine according to an embodiment of the present invention.
Figure 19A:
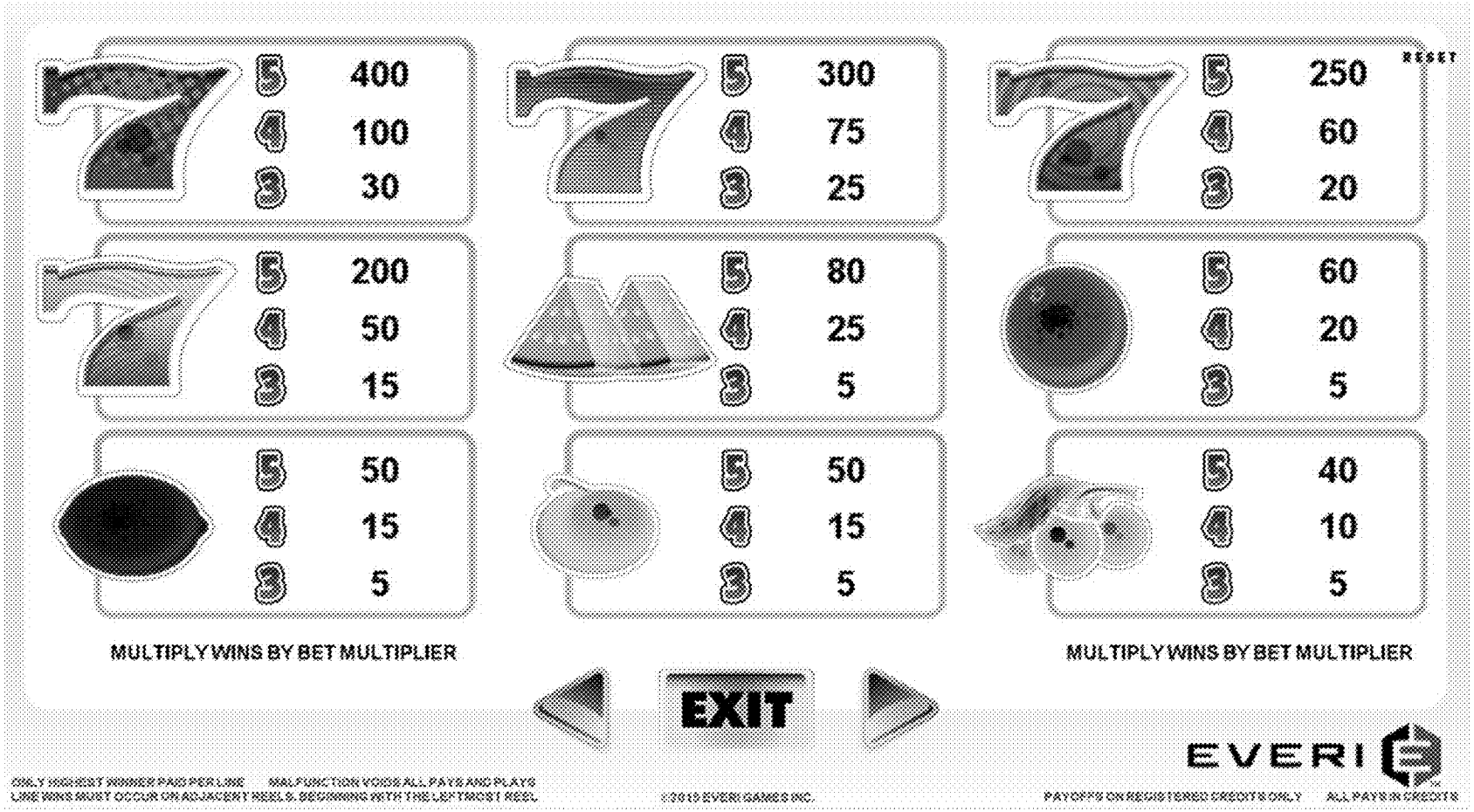
FIG. 19A is a representation of an additional pay table screen for a gaming machine according to an embodiment of the present invention.
Figure 19B:
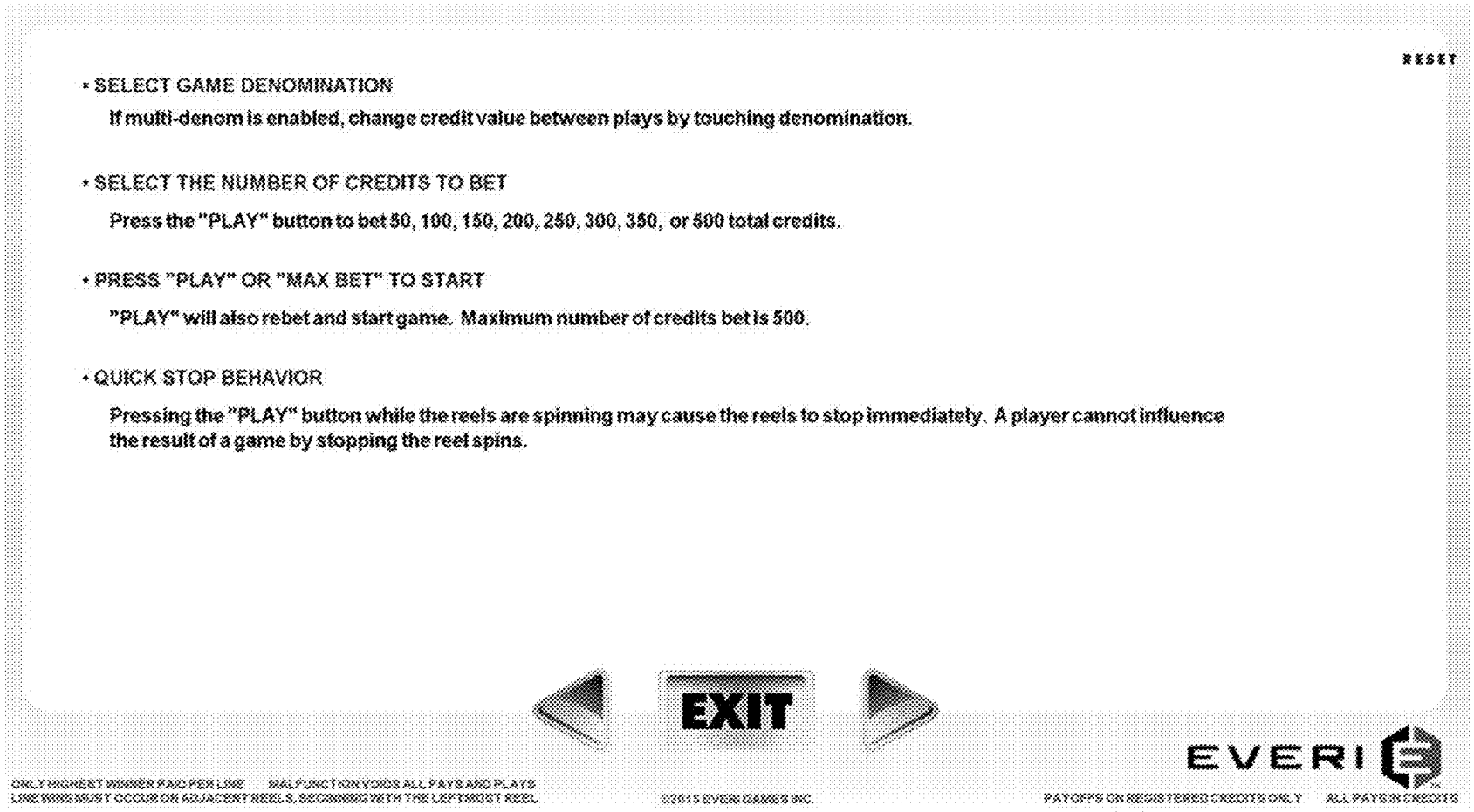
FIG. 19B is a representation of a help screen used in connection with the pay table display of FIG. 19A.
Figure 24:
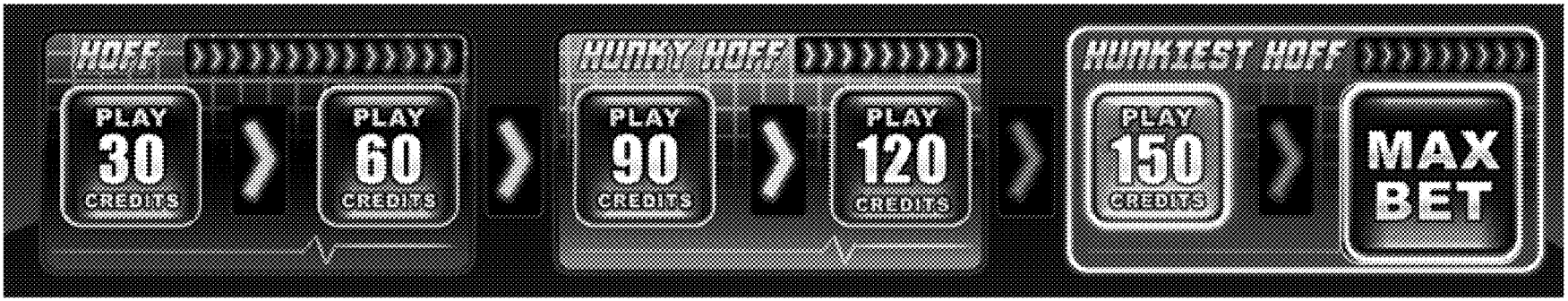
FIG. 24 is a representation of a button panel which may be displayed on a touch-screen button panel display where payout percentage has been selected by bet level.

FIGS. 18A and 19A shows examples of pay table screens whereas FIGS. 18B and 19B show help screens that may be used in implementations of the present invention. The differences between the screens shown in FIGS. 18A-B and 17A-B show how the information presented to a player at the gaming machine changes (or remains constant) depending upon the bet configuration in effect for the given play at the gaming machine.

FIG. 18A shows a portion of a pay table that may be generated on a suitable display of a gaming machine (such as a gaming machine 100 shown in FIG. 1). The pay table information relates a result along a payline defined through the matrix of suitable locations (such as the matrix shown in FIG. 4 for example) at the gaming machine to a number of credits awarded for that result on a given play. For example, 3, 4, and 5 of a certain style of "7" symbols 1802 correlates to prizes of 18, 60, and 240 credits, respectively. Continuing with this example, the pay table of FIG. 18A shows that the gaming machine pays 18 credits for a result of three of the symbols 1802 in a row along a payline for a minimum bet, which is shown in the help screen of FIG. 18B as 30 credits for this bet configuration. Bets of 60, 90, 150, and 300 are also available in the bet configuration for which this help screen applies, representing bets at bet multipliers of 2, 3, 5, and 10, respectively. This bet configuration would require that the implementing gaming machine include a player control arrangement to allow the player to select the desired bet from among the available bet levels. This player control arrangement might be the configurable button panel shown in FIGS. 15-17, however, the panel would show five buttons labeled to indicate 30, 60, 90, 150, and 300 credits. As indicated by the note "MULTIPLY WINS BY BET MULTIPLIER" shown in the lower left corner of FIG. 18A, the payout value for three of the "7" symbols 1802 would be 36 credits for a 60 credit bet (the 18 credit payout value multiplied by the bet multiplier "2").

FIGS. 19A-B show screens corresponding to those in FIGS. 18A-B, respectively, but for a different bet configuration which may be active at a gaming machine (100 in FIG. 1) configured according to the present invention. It will be noted from FIG. 19B that this particular bet configuration includes eight bet levels including values 50, 100, 150, 200, 250, 300, 350, and 500 applying bet multipliers 1, 2, 3, 4, 5, 6, 7, and 10. This bet configuration could use a player control arrangement including eight buttons labeled 50, 100, 150, 200, 250, 300, 350, and 500 to allow the player to select their desired bet from among those available for a given play of the game for which this bet configuration is active. Such a control arrangement could be generated on a touch screen button panel such as that shown in FIGS. 15-17.

It will be appreciated by comparing FIGS. 18A and 19A that the underlying game displayed on the gaming machine uses the same game symbols (such as the "7" symbol 1802) and the same win definitions (number of symbols along a payline), but uses different payouts based on the active bet configuration. This flexibility in providing the same game with different bet configurations allows casino operators or perhaps a player to use the desired bet levels for the underlying game without changing the gaming machine or characteristics of the underlying game.

It will also be noted by comparing FIGS. 18A-B to the corresponding FIGS. 19A-B that although much of the information in the corresponding screens is the same, other information changes. For example, FIGS. 18A and 19A show that credit values (pay table values) corresponding to the various win definitions change from one bet configuration to another. FIG. 18A shows a payout value of 18 credits for three symbols 1802 in a row, while FIG. 19A shows a payout value of 30 credits for that same win definition for instance. The information on bet levels and maximum bet also change from one bet configuration to another. The instruction for selecting the number of credits to bet for a play of the gaming machine shows the values "30, 60, 90, 150, or 300" and the information for the "MAX BET" control shows the value "300" for the bet configuration active when the screen in FIG. 18B is displayed, whereas that instruction for the bet configuration active when the screen in FIG. 19B is displayed shows the values "50, 100, 150, 200, 250, 300, 350, or 500" and the max bet instruction shows "500." To accommodate this change from one bet configuration to another, some implementations of the present invention may include storing data defining a template including all common information between the screens, that is, including all information that does not change from one bet configuration to another. Each screen template includes an open field or placeholder for each item of information that does change from one bet configuration to another and this information may be stored in a separate file and used to populate the open fields in the template data. For example, a gaming system may store a template to display the screen shown in FIG. 18A without the payout values and for each available bet configuration, store a separate file containing the payout values for that bet configuration. When a bet configuration is activated at a gaming machine, the invention would then include reading the template data to produce the main portion of the screen and reading the corresponding field populating file for that screen and that bet configuration to obtain the information to populate the values in the screen template. Thus only a single template need be stored for the screen along with a separate file containing the data for each different bet configuration, or a single file comprising a table from which the bet configuration specific data may be read.

The information set out in FIGS. 18B and 19B shows that the player may select their bet for a given play in the underlying game by choosing one of the available bet credit levels. This selection of bet level in implementations of the present invention may be independent of the number of paylines that are active for a given play in the game. Implementations of the present invention may in fact specify a particular number of paylines that are active for each play and cannot be changed by the player. This is in contrast to prior art arrangements that require the player to choose a number of paylines to activate for a given play with a certain bet per payline, and this ability to activate different numbers of paylines allows the player to select the amount of their bet for the given play. As noted previously, one advantage of the of the present invention is that the player may change their bet for the underlying game without changing the characteristics of play as is the case when different numbers of paylines are activated according to prior art arrangements. Furthermore, since all paylines may be active for each play in an implementation of the present invention, it is easier for the player to identify their winning results.

FIGS. 20A-22 show tables or portions of tables showing example bet level progressions for a given maximum and minimum bet. These example relationships vary from one minimum bet to the next as indicated in the different tables. Referring to FIG. 20B for example, where a minimum bet is selected as 50 credits, a maximum bet is selected as 500 credits and four bet levels are selected, the four bet buttons could be defined as 50 credits, 100 credits, 300 credits, and 500 credits. The data represented by these tables is stored in some suitable fashion in a data storage system (on or more data storage devices) associated with the gaming machine and is retrieved in response to selections in order to configure the gaming machine accordingly. For example, when a user is configuring a row in the interface of FIGS. 10 and 11, a pull-down menu is populated with the allowed bet configurations available for that minimum bet, maximum bet, and number of bet levels. That is, the stored data for the bet configuration is read from storage and used to populate the choices in the pull-down menu.

Figure 25:
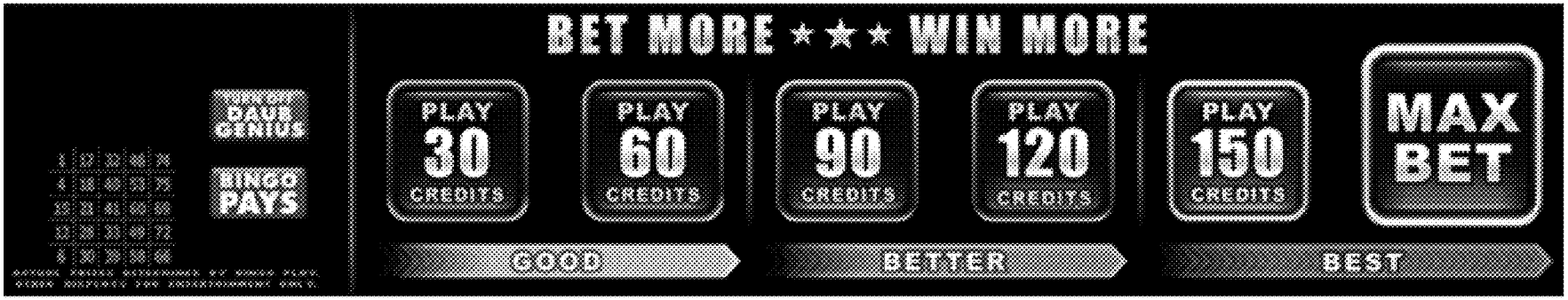
FIG. 25 is another representation of a button panel which may be displayed on a touch-screen button panel display where payout percentage been selected by bet level.
Figure 26:
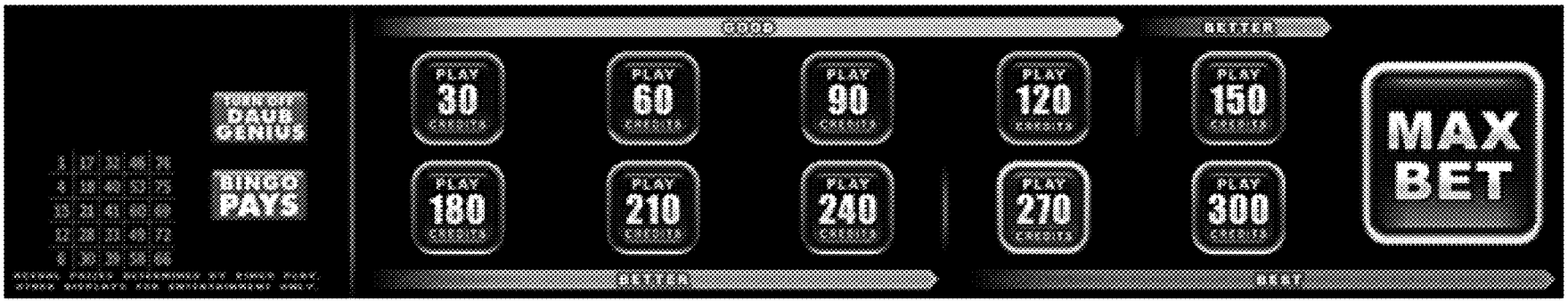
FIG. 26 is another representation of a button panel which may be displayed on a touch-screen button panel display where payout percentage been selected by bet level.
Figure 27:
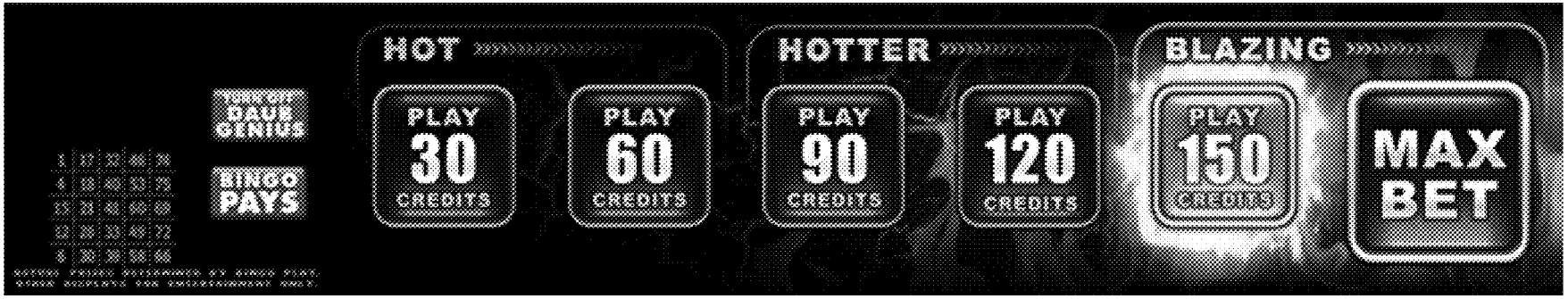
FIG. 27 is another representation of a button panel which may be displayed on a touch-screen button panel display where payout percentage has been selected by bet level.
Figure 28:
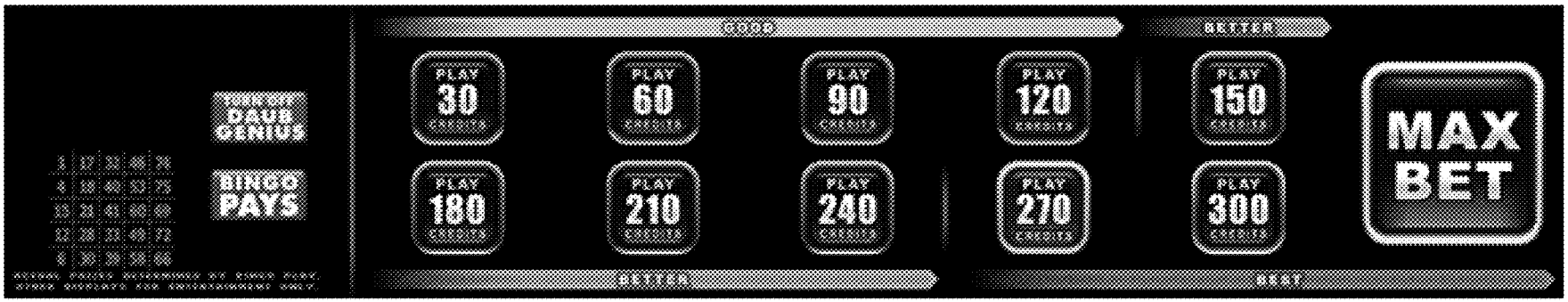
FIG. 28 is another representation of a button panel which may be displayed on a touch-screen button panel display where payout percentage has been selected by bet level.
Figure 29:
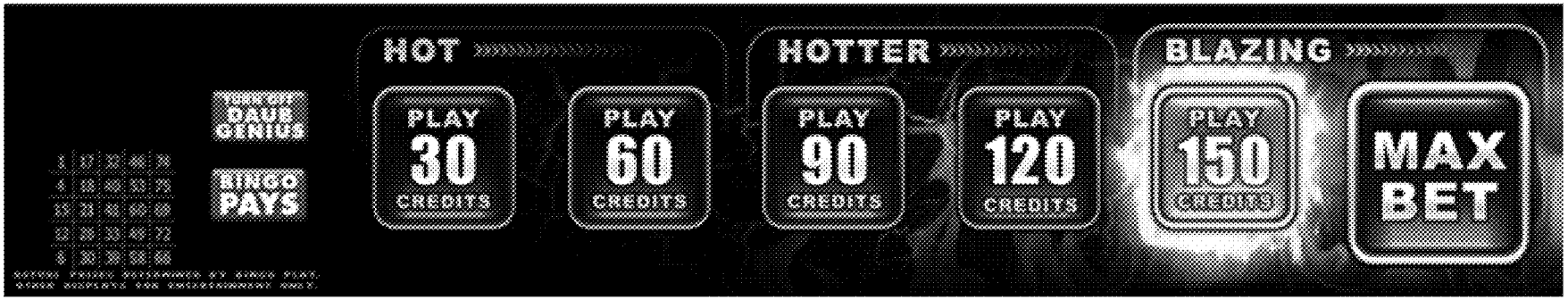
FIG. 29 is another representation of a button panel which may be displayed on a touch-screen button panel display where payout percentage has been selected by bet level.
Figure 30:
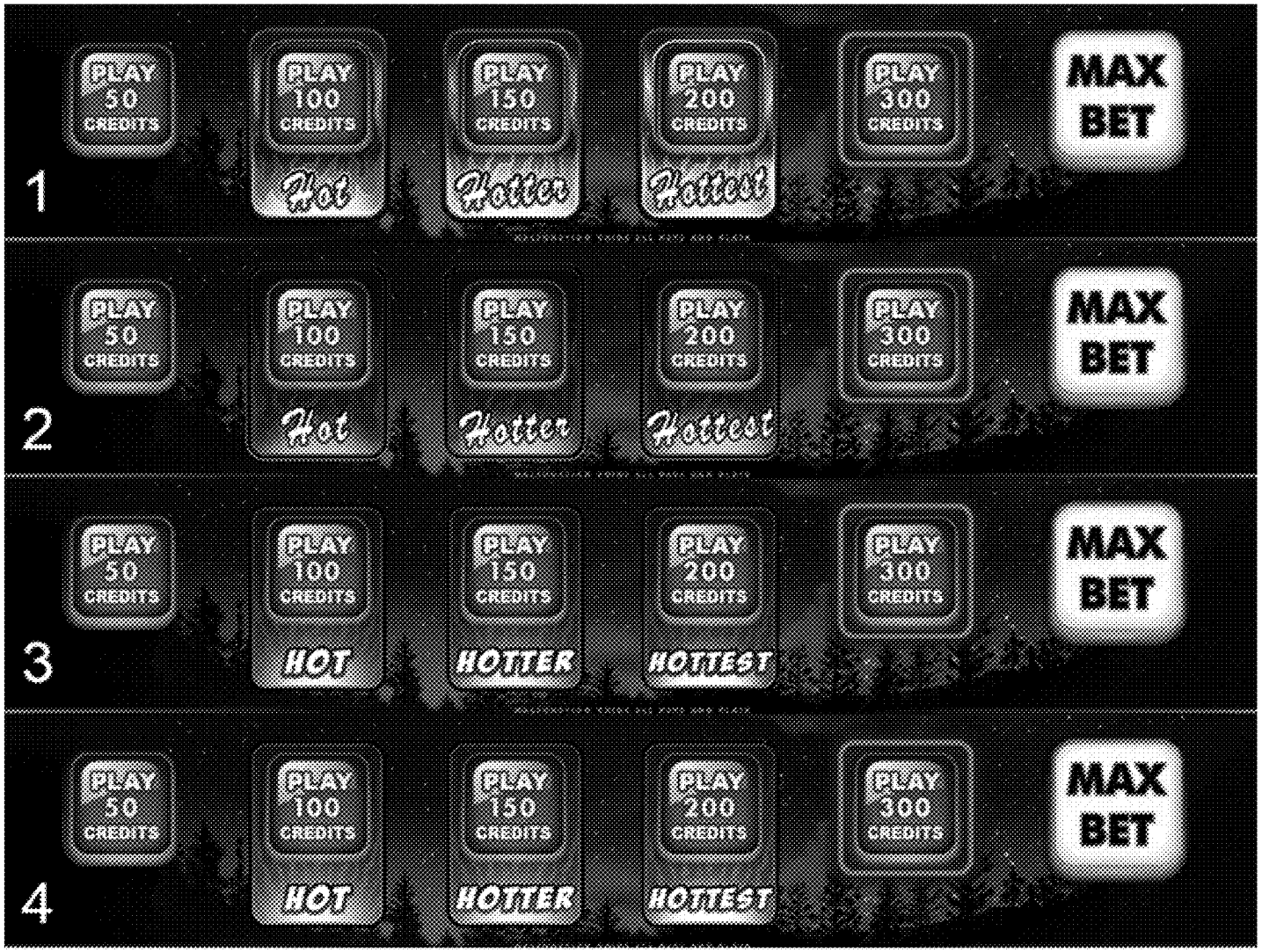
FIG. 30 is a representation showing four separate alternatives for a button panel which may be displayed on a touch-screen button panel display where payout percentage has been selected by bet level.

In cases where the payout percentage may be selected for the various bet levels, it may be desirable or perhaps necessary configure the bet levels so that payout percentage is higher for higher bet levels, and perhaps increase from one bet level to the next or at least one group of adjacent bet levels to the next higher group. Particularly in these cases, and perhaps in other cases, it may be desirable to provide an indication to the player regarding the relative payout percentage between bet levels or groups of adjacent bet levels. FIGS. 24-29 provide examples of button panel displays which provide an indication to the player as to relative payout percentage between the various bet levels. FIG. 28 shows four different button panel displays labeled 1, 2, 3, and 4 each showing an indication to the player as to relative payout percentage between the various bet levels. Referring to FIG. 25 for example, the 30 and 60 credit bet level buttons are provided with an adjacent label "Good," the 90 and 120 credit bet level buttons are provided with the adjacent label "Better," and the 150 credit and max bet level buttons are provided with the adjacent label "Best." These labels in FIG. 25 might be appropriate where the payout percentage selected for the 30 and 60 credit bet level buttons is at a first value, 90% for example, the payout percentage selected for the 90 and 120 credit bet level buttons is at a second value greater than the first value, 94% for example, and the payout percentage selected for the 150 credit bet level button is a third value greater than the second value, 98% for example. Relative payout percentage indicating labels according to this aspect of the invention may be color coded and any appropriate text or graphic labels or indicators could be used such as Hot, Hotter, Hottest and Hot, Hotter, Blazing for example. The relative payout percentage indicating labels such as those shown in the examples may be displayed automatically based on the payout percentages selected for the various bet levels configured for a play in the game. Of course, for static button panels, physical labels could be applied to the various bet level selection controls to provide the desired relative payout percentage indication.

The example bet level button (virtual button) arrangements shown in FIGS. 26-29 each include a bingo card representation and virtual controls associated with play in bingo games. These elements in the figures simply indicate that the results for the reel-type games displayed for a given game play at the gaming machine are obtained from an underlying bingo game rather than from some other random result generating system.

FIGS. 31 and 32 provide two different examples of a reel-type game display and corresponding bet level button arrangement for a particular bet configuration made according to aspects of the present invention. Each of FIGS. 31 and 32 shows a reel-type game matrix 3101 for a four-line, five-reel game together with a set of fields providing information on play. These fields include a credit field 3102 used to show available credits during play, a win field 3103 used to show the credits won for a given play, a bet multiplier field 3104 used to show the bet multiplier applied for a given bet placed at the gaming machine, a bet field 3105 used to show the bet in credits placed for a given play, and a denomination field 3106 showing the denomination in effect for a play at the gaming machine. This display made up of the game matrix 3101 and row of information fields may be displayed on a main display device of a gaming machine such as device 104 on gaming machine 100 in FIG. 1 for example.

FIGS. 31 and 32 also each show a respective button panel 3110 and 3210, respectively, populated with bet buttons which may be used by the player to select a bet level for a play in the game. This button panel display may be displayed on any suitable touch screen device of the gaming machine, and preferably a touch screen device on button panel 106 in FIG. 1 (the touch screen being in addition to physical buttons 110 or in lieu of physical buttons 110 shown in FIG. 1). Regardless of how and where the button panels 3110 and 3210 are generated, they are each populated with bet level buttons for bet levels which have been configured for a play in the game according to the various aspects of the invention. The button panel 3110 of FIG. 31 comprises a button panel that may be produced for the bet level configuration shown in the top row of FIG. 14, and includes ten bet level buttons 3112 ranging from a minimum bet level of 50 credits to a maximum bet level of 500 credits, and applying the multiplier sequence 1, 2, 3, 4, 5, 6, 7, 8, 9, and 10. A relative payout percentage indicator 3114 comprising a distinctively colored bar labeled "Hot" is displayed adjacent to the first five bet level buttons 3112 of button panel 3110, while a relative payout percentage indicator 3115 comprising a distinctively colored bar labeled "Hotter" is displayed adjacent to the next four bet level buttons of panel 3110. A distinctively colored bar labeled "Blazing" adjacent to the final bet level button in the sequence comprises a relative payout percentage indicator 3116 for that last bet level.

Figure 14:
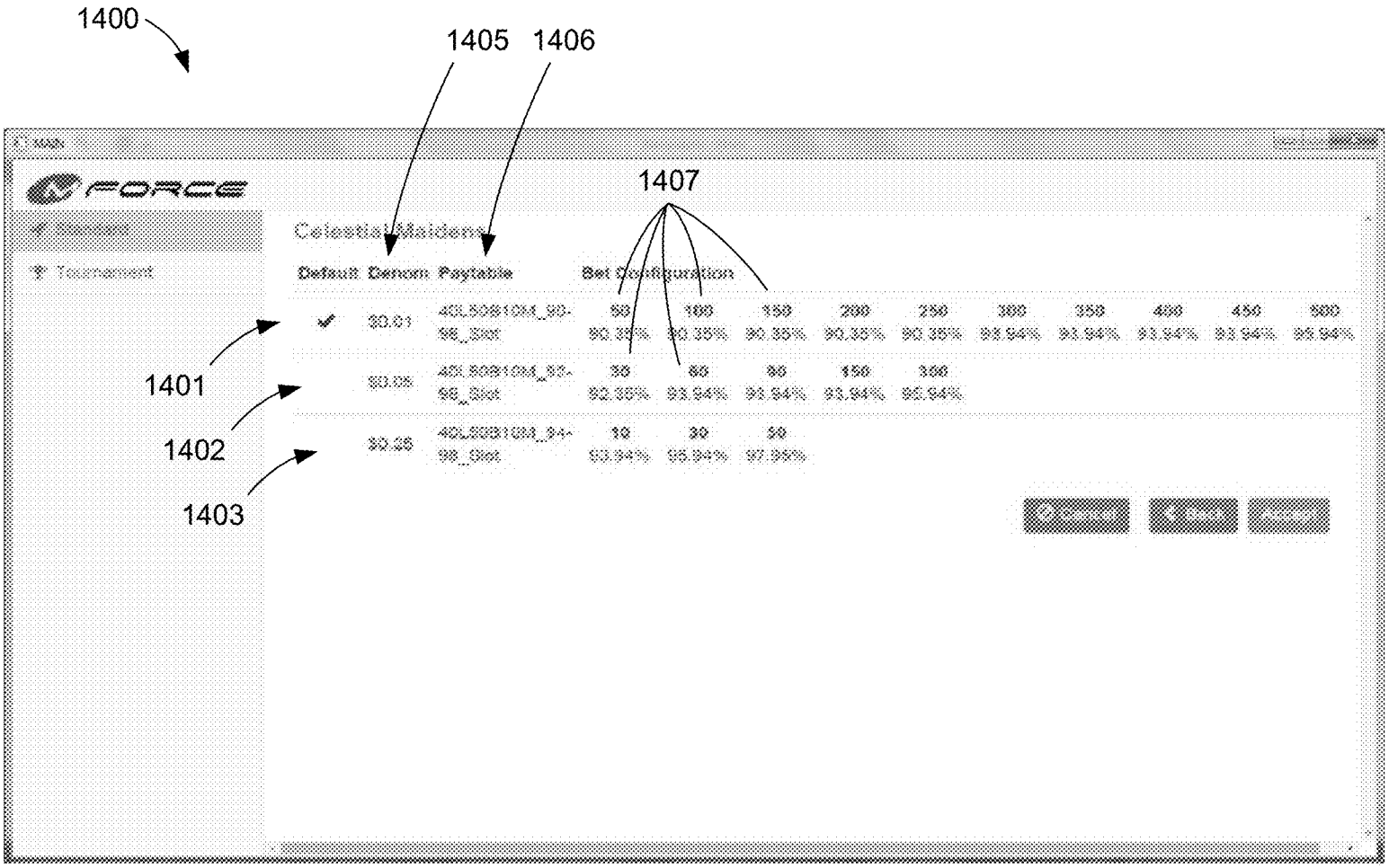
FIG. 14 is a representation of the user interface shown in FIG. 12 once all of the payout percentage selections have been entered for the displayed combinations.

The button panel 3210 of FIG. 32 comprises a button panel that may be produced for the bet level configuration shown in the bottom row of FIG. 14, and includes just three bet level buttons 3212 applying the multiplier sequence 1, 3, and 5 (corresponding to bet levels 10, 30, and 50 at the denomination $0.25. A relative payout percentage indicator comprising a distinctively colored bar and textual label is included for each bet level button 3212. In particular a relative payout percentage indicator 3214 labeled "Hot" is displayed adjacent to the "Play 10 credits" bet level buttons 3212 of button panel 3210, a relative payout percentage indicator 3215 labeled "Hotter" is displayed adjacent to the "Play 30 credits" bet level buttons of panel 3210, and a relative payout percentage indicator 3216 labeled "Blazing" is displayed adjacent to the "Play 50 credits" bet level button 3212.

The two example displays shown in FIGS. 31 and 32 may be presented on a single gaming machine such as gaming machine 100 in FIG. 1 at different times depending upon the player's selection of denomination. For example, the display shown in FIG. 31 may comprise the default configuration, as indicated in FIG. 14, and may be displayed at the gaming machine when the bet configurations shown in FIG. 14 are placed in effect at a gaming machine. The player may change the denomination by invoking the control associated with denomination field 3106. Selecting the denomination $0.25 would cause the display to change from have shown in FIG. 31 to that shown in FIG. 32. The player could shift back to the display shown in FIG. 31 by selecting the $0.01 denomination again or, assuming the second row 1402 configuration from FIG. 14 is active at the gaming machine, select the denomination of $0.05. Such a selection would cause an appropriate button panel to be displayed for the bet configuration, namely, a button panel with five buttons starting with the minimum configured bet of 30 credits, and applying the bet multiplier sequence 1, 2, 3, 5, and 10. It should be noted that this selection of denomination by the player is distinct from the configuration of bet levels for a given denomination in accordance with the example process described in connection with FIGS. 5-14.

Another additional configuration available according to aspects of the present invention may relate to progressive prizes available in the game. For example, the user may have the option of adding a progressive prize to a given game, or alternatively, a given game may be designated (hardwired) to be a progressive. In either case, a game may offer a progressive prize possible only for plays made at the maximum bet level. In such a case, the reset value of the progressive scales by the ratio of the maximum bet levels available for the game, and the growth/increment rate for the progressive pool remains unchanged at all configurations. This scaling and growth/increment rate arrangement keeps the payout percentage constant across all of the different maximum bets that are available to be selected in accordance with, for example, process block 510 in FIG. 5.

As used herein, whether in the above description or the following claims, the terms "comprising," "including," "carrying," "having," "containing," "involving," and the like are to be understood to be open-ended, that is, to mean including but not limited to. Any use of ordinal terms such as "first," "second," "third," etc., in the claims to modify a claim element does not by itself connote any priority, precedence, or order of one claim element over another, or the temporal order in which acts of a method are performed. Rather, unless specifically stated otherwise, such ordinal terms are used merely as labels to distinguish one claim element having a certain name from another element having a same name (but for use of the ordinal term).

The term "each" may be used in the following claims for convenience in describing actions, functions, characteristics, or features of multiple elements, and any such use of the term "each" is in the inclusive sense unless specifically stated otherwise. For example, if a claim defines two elements as "each" having a characteristic or feature, the use of the term "each" is not intended to exclude from the claim scope a situation having a third one of the elements which does not have the defined characteristic or feature.

The above-described preferred embodiments are intended to illustrate the principles of the invention, but not to limit the scope of the invention. Various other embodiments and modifications to these preferred embodiments may be made by those skilled in the art without departing from the scope of the present invention.

The invention claimed is:

1. A method of configuring a gaming machine which displays a result of a respective play of the gaming machine through a matrix of game symbol locations which are adapted to be populated for the respective play with a respective game symbol selected from a set of game symbols, the matrix of game symbol locations having defined therein a set of one or more winning symbol location patterns, the method including:

(a) at a data storage system operably connected to the gaming machine, storing a first bet configuration for a game denomination specifying (i) a first configuration pay table and (ii) a first configuration set of bet levels including a first configuration minimum bet for a respective play on the gaming machine and a first configuration higher-level bet for a respective play on the gaming machine, the first configuration pay table including a number N of prize levels with each prize level corresponding to a respective first configuration numerical prize value for a respective winning combination of game symbols in any one of the winning symbol location patterns for a respective play on the gaming machine at the first configuration minimum bet, the first configuration higher-level bet comprising a respective multiple of the first configuration minimum bet;

(b) storing at the data storage system a second bet configuration for the game denomination specifying (i) a second configuration pay table, and (ii) a second configuration set of bet levels including a second configuration minimum bet unequal to the first configuration minimum bet for a respective play on the gaming machine and a second configuration higher-level bet for a respective play on the gaming machine, the second configuration pay table including N prize levels with each prize level corresponding to a respective second configuration numerical prize value for a respective winning combination of game symbols in any one of the symbol location patterns for a respective play on the gaming machine at the second configuration minimum bet, and the second configuration minimum bet being related to the first configuration minimum bet by a translation ratio and each second configuration numerical prize value being related to a corresponding one of the first configuration numerical prize values by the translation ratio, the second configuration higher-level bet comprising a respective multiple of the second configuration minimum bet;

(c) through a user interface system for the gaming machine, receiving a bet configuration activation input and, in response to the bet configuration activation input, placing a corresponding one of the first bet configuration or the second bet configuration in an active state for the gaming machine;

(d) while the corresponding one of the first bet configuration or second bet configuration is in the active state for the gaming machine, receiving a game play input through a player input system of the gaming machine, the game play input specifying a wager for a respective play at the gaming machine and initiating a play on the gaming machine, the wager comprising a bet level specified in the corresponding one of the first bet configuration or second bet configuration;

(e) in response to the game play input, conducting the play on the gaming machine to populate the game symbol locations with game symbols from the set of game symbols; and (f) for each winning combination of game symbols in a respective winning symbol location pattern in the matrix of game symbol locations as populated for that play on the gaming machine, awarding the respective prize for that combination of game symbols as defined by the corresponding one of the first bet configuration or second bet configuration.

2. The method of claim 1 wherein:

(a) the corresponding one of the first bet configuration or second bet configuration comprises the first bet configuration; and (b) placing the first bet configuration in the active state for the gaming machine includes modifying the player input system of the gaming machine to include a respective first bet configuration control corresponding to each bet level in the first configuration set of bet levels.

3. The method of claim 2 wherein modifying the player input system of the gaming machine includes adding a virtual control button to a touch screen display panel.

4. The method of claim 2 wherein modifying the player input system of the gaming machine includes activating a physical control and modifying an illumination state of the physical control.

5. The method of claim 1 wherein storing the first bet configuration includes storing one or more first bet configuration-specific data files including data to be placed in fields included in one or more instruction screen templates when the first bet configuration is in the active state.

6. The method of claim 1 wherein the set of one or more winning symbol location patterns includes a scatter pay.

7. The method of claim 1 wherein:

the second bet configuration comprises one of a number of additional bet configurations for the game denomination stored at the data storage system, each of the number of additional bet configurations specifying (i) a respective additional configuration pay table, and (ii) a respective set of additional configuration bet levels including a respective additional configuration minimum bet unequal to the first configuration minimum bet for a respective play on the gaming machine and a respective additional configuration higher-level bet for a respective play on the gaming machine, each respective additional configuration pay table including N prize levels with each prize level corresponding to a respective additional configuration numerical prize value for a respective winning combination of game symbols in any one of the symbol location patterns for a respective play on the gaming machine at the respective additional configuration minimum bet, and the respective additional configuration minimum bet being related to the first configuration minimum bet by a respective translation ratio and each respective additional configuration numerical prize value of that respective additional bet configuration being related to a corresponding one of the first configuration numerical prize values by the respective translation ratio, the respective additional configuration higher-level bet comprising a respective multiple of the respective additional configuration minimum bet.

8. A gaming machine including:

(a) a display system;

(b) a data storage system:

(c) a user interface;

(d) a player input system; and (e) at least one processor operable to execute program code to control the gaming machine to:

(i) store at the data storage system a first bet configuration for a game denomination specifying a first configuration pay table, specifying a first configuration set of bet levels including a first configuration minimum bet for a respective play on the gaming machine and a first configuration higher-level bet for a respective play on the gaming machine, the first configuration pay table including a number N of prize levels with each prize level corresponding to a respective first configuration numerical prize value for a respective winning combination of game symbols in a respective winning symbol location pattern for a play on the gaming machine at the first configuration minimum bet, the first configuration higher-level bet comprising a respective multiple of the first configuration minimum bet;

(ii) store at the data storage system a second bet configuration for the game denomination specifying a second configuration pay table and specifying a second configuration set of bet levels including a second configuration minimum bet unequal to the first configuration minimum bet for a respective play on the gaming machine and a second configuration higher-level bet for a respective play on the gaming machine, the second configuration pay table including N prize levels with each prize level corresponding to a respective second configuration numerical prize value for a respective winning combination of game symbols in a respective winning symbol location pattern for a play on the gaming machine at the second configuration minimum bet, and the second configuration minimum bet being related to the first configuration minimum bet by a translation ratio and each second configuration numerical prize value being related to a corresponding one of the first configuration numerical prize values by the translation ratio, the second configuration higher-level bet comprising a respective multiple of the second configuration minimum bet;

(iii) at the user interface, receive a bet configuration activation input and in response to the bet configuration activation input placing a corresponding one of the first bet configuration or the second bet configuration in an active state for the gaming machine;

(iv) while the corresponding one of the first bet configuration or second bet configuration is in the active state for the gaming machine, receive a game play input through the player input system, the game play input specifying a wager for a respective play at the gaming machine and initiating a play at the gaming machine, the wager comprising a bet level specified in the corresponding one of the first bet configuration or second bet configuration;

(v) in response to the game play input, conducting a play on the gaming machine to populate game symbol locations in a matrix of game symbol locations with game symbols from a set of game symbols; and (vi) for each winning combination of game symbols shown in the matrix of game symbol locations as populated for that play on the gaming machine, award the respective prize for that combination of game symbols as defined by the corresponding one of the first bet configuration or second bet configuration.

9. The gaming machine of claim 8 wherein:

(a) the corresponding one of the first bet configuration or second bet configuration comprises the first bet configuration; and (b) placing the first bet configuration in the active state for the gaming machine includes modifying the player input system to include a respective first bet configuration control corresponding to each bet level in the first configuration set of bet levels.

10. The gaming machine of claim 9 wherein modifying the player input system includes adding a virtual control button to a touch screen display panel.

11. The gaming machine of claim 9 wherein modifying the player input system includes removing a virtual control button from a touch screen display panel.

12. The gaming machine of claim 9 wherein modifying the player input system includes activating a physical control and modifying an illumination state of the physical control.

13. The gaming machine of claim 8 wherein storing the first bet configuration includes storing one or more first bet configuration-specific data files including data to be placed in fields included in one or more instruction screen templates when the first bet configuration is in the active state.

14. The gaming machine of claim 8 wherein:

the second bet configuration comprises one of a number of additional bet configurations for the game denomination stored at the data storage system, each of the number of additional bet configurations specifying (i) a respective additional configuration pay table, and (ii) a respective set of additional configuration bet levels including a respective additional configuration minimum bet unequal to the first configuration minimum bet for a respective play on the gaming machine and a respective additional configuration higher-level bet for a respective play on the gaming machine, each respective additional configuration pay table including N prize levels with each prize level corresponding to a respective additional configuration numerical prize value for a respective winning combination of game symbols in a respective winning symbol location pattern for a respective play on the gaming machine at the respective additional configuration minimum bet, and the respective additional configuration minimum bet being related to the first configuration minimum bet by a respective translation ratio and each respective additional configuration numerical prize value of that respective additional bet configuration being related to a corresponding one of the first configuration numerical prize values by the respective translation ratio, the respective additional configuration higher-level bet comprising a respective multiple of the respective additional configuration minimum bet.

15. A program product comprising one or more tangible, non-transitory computer-readable data storage devices storing program code, the program code including:

(a) game program code executable by one or more processing devices to (i) initiate a play on a gaming machine in response to a game play input entered from a player input system of the gaming machine, and to (ii) display a result of the play through a matrix of game symbol locations which are each populated for the play with a respective game symbol selected from a set of game symbols, the matrix of game symbol locations having defined there through a set of one or more winning symbol location patterns;

(b) bet configuration program code executable by the one or more processing devices to, in response to a bet configuration activation input entered through a user interface of the gaming machine, place a corresponding one of a first bet configuration or a second bet configuration in an active state for the gaming machine, wherein:

(i) the first bet configuration specifies:

a first configuration set of bet levels including a first configuration minimum bet for a respective play on the gaming machine at a first denomination and a first configuration higher-level bet for a respective play on the gaming machine at the first denomination, the first configuration higher-level bet comprising a respective multiple of the first configuration minimum bet, and a first configuration pay table which includes a number N of pay table levels with each pay table level corresponding to a respective first configuration numerical prize value for a winning combination of game symbols in a respective one of the one or more winning symbol location patterns, and (ii) the second bet configuration specifies:

a second configuration set of bet levels including a second configuration minimum bet for a respective play on the gaming machine at the first denomination and a second configuration higher-level bet for a respective play on the gaming machine at the first denomination, the second configuration higher-level bet comprising a respective multiple of the second configuration minimum bet, and a second configuration pay table which includes the number N of pay table levels with each pay table level corresponding to a respective second configuration numerical prize value for a winning combination of game symbols in a respective one of the one or more winning symbol location patterns, and (iii) the first configuration and second configuration minimum bets are unequal, the second configuration minimum bet is related to the first configuration minimum bet by a translation ratio, and each second configuration numerical prize value is related to a corresponding first configuration numerical prize value by the translation ratio; and (c) payout program code executable by the one or more processing devices to, for each winning combination of game symbols in the matrix of game symbol locations as populated for the play on the gaming machine, award the respective prize for that combination as defined by the corresponding one of the first bet configuration or second bet configuration which is in the active state for that play on the gaming machine.

16. The program product of claim 15 wherein:

(a) the corresponding one of the first bet configuration or the second bet configuration comprises the first bet configuration; and (b) placing the first bet configuration in the active state for the gaming machine includes modifying the player input system of the gaming machine to include a respective first bet configuration control corresponding to each bet level in the first configuration set of bet levels.

17. The program product of claim 16 wherein modifying the player input system of the gaming machine includes adding a virtual control button to a touch screen display panel.

18. The program product of claim 16 wherein modifying the player input system includes removing a virtual control button from a touch screen display panel.

19. The program product of claim 15 wherein modifying the player input system includes activating a physical control and modifying an illumination state of the physical control.

20. The program product of claim 15 wherein:

(a) the first bet configuration includes one or more first bet configuration-specific data files including data to be placed in fields included in one or more instruction screen templates when the first bet configuration is in the active state; and (b) the second bet configuration includes one or more second bet configuration-specific data files including data to be placed in the fields included in the one or more instruction screen templates when the second bet configuration is in the active state.

* * * * *